US005519411A

United States Patent [19]

Okada et al.

[11] Patent Number: 5,519,411

[45] Date of Patent: May 21, 1996

[54] LIQUID CRYSTAL DISPLAY APPARATUS

[75] Inventors: Shinjiro Okada, Isehara; Yutaka Inaba, Kawaguchi; Kazunori Katakura, Atsugi, all of Japan

[73] Assignee: Canon Kabushiki Kaisha, Tokyo, Japan

[21] Appl. No.: 376,375

[22] Filed: Jan. 23, 1995

Related U.S. Application Data

[63] Continuation of Ser. No. 984,694, Dec. 2, 1992, abandoned.

[30] Foreign Application Priority Data

Dec. 4, 1991 [JP] Japan ..... 3-320542

[51] Int. Cl.[6] ..... G09G 3/19

[52] U.S. Cl. ..... 345/89; 345/95; 345/103; 345/208; 359/56

[58] Field of Search ..... 359/54, 55, 56, 359/60; 345/87, 89, 94, 95, 97, 101, 103, 208, 210; 348/751, 761, 766, 790

[56] References Cited

U.S. PATENT DOCUMENTS

| | | | |
|---|---|---|---|
| 4,531,160 | 7/1985 | Ehn | 345/147 |
| 4,778,260 | 10/1988 | Okada et al. | 359/56 |
| 4,800,382 | 1/1989 | Okada et al. | 345/97 |
| 4,824,218 | 4/1989 | Kuno et al. | 359/56 |
| 4,836,656 | 6/1989 | Mouri et al. | 359/56 |
| 4,840,460 | 6/1989 | Berrot et al. | 359/55 |
| 4,932,759 | 1/1990 | Toyono et al. | 345/97 |
| 4,958,915 | 9/1990 | Okada et al. | 345/97 |
| 4,973,135 | 11/1990 | Okada et al. | 359/56 |
| 5,013,137 | 5/1991 | Tsuboyama et al. | 359/56 |
| 5,026,144 | 6/1991 | Taniguchi et al. | 359/56 |
| 5,126,865 | 6/1992 | Sarma | 345/89 |
| 5,132,818 | 7/1992 | Mouri et al. | 359/56 |
| 5,136,282 | 8/1992 | Inaba et al. | 345/97 |
| 5,182,549 | 1/1993 | Taniguchi et al. | 340/805 |
| 5,245,450 | 9/1993 | Ukai et al. | 345/87 |

FOREIGN PATENT DOCUMENTS

| | | |
|---|---|---|
| 0240010 | 10/1987 | European Pat. Off. . |
| 0272079 | 6/1988 | European Pat. Off. . |
| 0276864 | 8/1988 | European Pat. Off. . |
| 0453856 | 10/1991 | European Pat. Off. . |
| 61-094023 | 5/1986 | Japan . |
| 62-150226 | 7/1987 | Japan . |
| 63-186215 | 8/1988 | Japan . |
| 88005170 | 7/1988 | WIPO ..... 345/93 |

OTHER PUBLICATIONS

Mol. Cryst. Liq. Cryst., (1983), vol. 94, Nos. 1 and 2 (pp. 213–234).

*Primary Examiner*—Richard Hjerpe
*Assistant Examiner*—Lun-Yi Lao
*Attorney, Agent, or Firm*—Fitzpatrick, Cella, Harper & Scinto

[57] ABSTRACT

A liquid crystal display apparatus comprising: a liquid crystal cell in which ferroelectric liquid crystal is disposed between two electrode substrates disposed to face each other and an intersection portion between a scanning electrode group and an information electrode group respectively formed on the electrode substrates is made to be a pixel; a scanning signal applying device; and an information signal applying device, wherein the pixel has a threshold distribution with respect to a gradation information signal at the time of a scanning selection operation, the scanning signal applying device simultaneously applies scanning signals to a plurality of scanning electrodes in synchronization with an operation in which the information signal applying device applies the gradation information signal to an information electrode, and the scanning signals applied simultaneously have different waveforms.

10 Claims, 30 Drawing Sheets

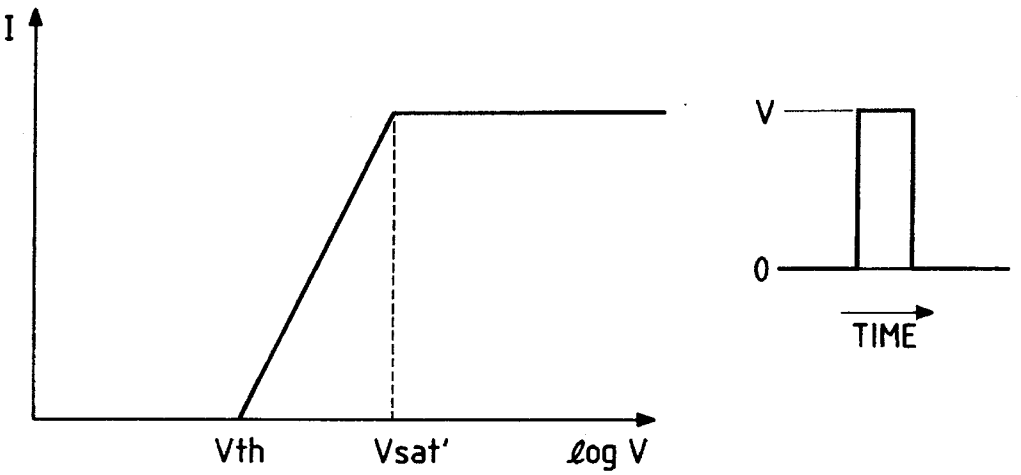
FIG. 9
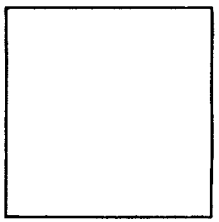
FIG. 10A
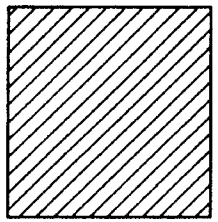
FIG. 10B
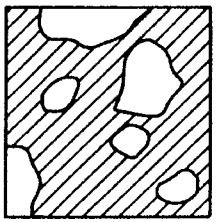
FIG. 10C
FIG. 10D T(%)
200
100
T3
T2
T1
V0
V100
log V
SCANNING LINE 1
SCANNING LINE 2

A PIXEL
B PIXEL
V100
V0
T1°C
<
T2°C
<
T3°C $$\frac{V3}{V2} = \frac{V2}{V1} = \frac{\alpha 1}{\alpha 2}$$

LIQUID CRYSTAL DISPLAY APPARATUS

This application is a continuation of application Ser. No. 07/984,694 filed Dec. 2, 1992, now abandoned.

BACKGROUND OF THE INVENTION

1. Field of the Invention

The present invention relates to a display apparatus, which uses ferroelectric liquid crystal (FLC), and a method of driving the same, and, more particularly, to a liquid crystal display apparatus which displays image gradation by a matrix drive method and a method of driving the same.

2. Related Background Art

As for the display apparatus, which uses a ferroelectric liquid crystal (FLC), there has been a known device disclosed in Japanese Patent Application Laid-Open No. 61-94023 and constituted in such a manner that ferroelectric liquid crystal is injected into a liquid crystal cell formed by placing two glass plates, each of which has a transparent electrode formed thereon and whcih have been subjected to an orienting process in such a manner that the two glass plates are placed while having a cell gap of about 1 μm~3 μm.

The aforesaid display apparatus which uses ferroelectric liquid crystal has two characteristics. That is, a fact, that the ferroelectric liquid crystal has a spontaneous polarization, causes combining force of an external electric field and the spontaneous polarization to be utilized to be utilized in switching. Another effect can be obtained in that the switching operation can be performed by the polarity of an external electrode because the longer axes of ferroelectric liquid crystal molecules correspond to the directions of the spontaneous polarizations.

The longer axes of the liquid crystal molecule of the ferroelectric liquid crystal are oriented in twisted directions under a bulk condition because the ferroelectric liquid crystal ordinarily uses chiral smectic liquid crystal (SmC* SmH*). However, the aforesaid problem that the longer axes of the lqiuid crystal molecules are undesirably twisted can be overcome by injecting the ferroelectric liquid crystal into the aforesaid cell having the cell gap of 1μm~ 3 μm. The aforesaid phenomenon has been disclosed in p213 to p234, N. A. CLARK et al., MCLC, 1983, Vol 94 and so forth.

Although the ferroelectric liquid crystal has been mainly utilized as a binary (light and dark) display device having two stable states composed of a light transmissive state and a light shielded state, multi-value images, that is, half tone images can also be displayed. The half tone image display methods are exemplified by a method which realizes a half-tone type light transmissive state by controlling the area ratio in a bi-stable state (the light transmissive state or the light shielded state) in a pixel. Then, the gradation expressing method (hereinafter called an "area modulation method") will now be described.

FIG. 9 is a graph which schematically illustrates the relationship between switching pulse V of the ferroelectric liquid crystal device and transmissive light quantity I of the same, where transmissive light quantity I realized after a single pulse of either polarity is applied to a pixel in an initial state in which it is completely shielded from light (dark state) is plotted as the function of voltage V of the single pulse. If the pulse voltage V is lower than threshold $V_{th}$. ($V<V_{th}$), the transmitted light quantity is not changed, and the transmissive state after the pulse has been applied is, as shown in FIG. 10B, the same as that shown in FIG. 10A. If the pulse voltage V is higher than the threshold, ($V_{th}<V$), a portion in the pixel is brought to another stable state, that is, a light transmissive state as shown in FIG. 10C so that the overall light quantity becomes an intermediate quantity. If the pulse voltage is raised to a value higher than saturation value $V_{sat}$ ($V_{sat}<V$), the overall portion of the pixel is brought into a light transmissive state as shown in FIG. 10D, and therefore the light quantity reaches a predetermined value (saturated).

That is, the area gradation method is a method for forming half tone images corresponding to the applied voltage V by performing a control in which the pulse voltage V is caused to meet $V_{th}<V<V_{sat}$.

However, the following problem arises if the aforesaid simple driving method is employed. That is, the fact that the relationship between the voltage and the transmissive light quantity depends upon the thickness of the cell and the temperature will arise a problem in that a different gradation is displayed depending upon the position in the display panel although a pulse voltage of a predetermined level is applied if a cell-thickness or the temperature is dispersed in the display panel.

FIG. 11 is a graph which illustrates the aforesaid fact, where the relationship between the pulse voltage V and the transmissive light quantity I is shown similarly to FIG. 9. In FIG. 11, the relationship between the two factors at different temperatures, that is, curve H indicating the relationship held at high temperature and curve L indicating the relationship held at low temperature are shown. In general, a display of a type having a large size frequently encounters a fact that the temperatures are dispersed in the same panel. Therefore, when a half tone image is formed at a certain driving voltage $V_{ap}$, a problem arises in that the half tone level is distributed irregularly in a range from $I_1$ to $I_2$ in the same panel as shown in FIG. 11 and therefore a uniform gradation image cannot be formed.

In order to overcome the aforesaid problem, a driving method (hereinafter called a "4-pulse method") has been disclosed in Japanese Patent Application No. 2-94384 by the applicant of the present invention (inventor: Okada). As shown in FIGS. 8 and 12, the "4-pulse method" is a method in which a plurality of pulses (pulses A, B, C and D shown in FIG. 12) are applied to all of a plurality of pixels positioned on the same scanning line in one panel and having different thresholds so as to obtain the same quantity of transmissive light as shown in FIG. 8.

However, use of the aforesaid "4-pulse method" will arise the following problem in that optical responses of the pixel with respect to the applied writing pulses (A), (B), (C) and (D) are respectively affected by other pulses previously applied to the aforesaid pixel during a process in which the reset pulse (A) is applied to the pixel on a selected scanning line and then gradation information writing pulses (B), (C) and (D) are applied as shown in FIGS. 8 and 12. That is, the voltage (threshold), at which the liquid crystal is inverted, is changed when the next pulse is applied. The aforesaid phenomenon will raise a problem at the time of setting the voltage of the pulse (B). Although the error is included by an allowable range (although the accuracy in expressing the gradation deteriorates) if the influence of the other pulse is limited and the degree of the threshold change is also limited, forming of gradation images cannot be performed by the 4-pulse method if the threshold is changed considerably. The reason for this lies in that the aforesaid "4-pulse method" disclosed in Japanese Patent Application No. 3-73127 is a driving method based on a fact that the inversion characteristics of liquid crystal with respect to the voltages of the four pulses applied to the pixel are the same.

Furthermore, domain walls such as i, j and k (the boundary between the oriented region corresponding to the light state and the oriented region corresponding to the dark region) shown in FIG. 8 must be included by the pixel in the case where the other pulses (B), (C) and (D) are applied because bright and dark domains present in the pixel, to which the voltage has been applied, while being mixed with each other (in a state where a half tone image is displayed) although the pulse (A) shown in FIG. 8 can be set to a voltage level sufficiently higher than the threshold because it is a reset pulse. As described above, the positions of the domain walls i, j and k are affected considerably by the voltage pulse applied immediately as well as the writing pulses (B), (C) and (D) in the case where switching is performed with the voltage which extremely approximates the inversion threshold of the liquid crystal. Although the influence of the other pulse applied immediately before the writing pulses are applied does not raise a critical problem in the case where the change of the voltage of the pulses applied immediately is limited, a problem sometimes arises in that the "4-pulse method" drive cannot be performed if the change has been made considerably.

The aforesaid problem taken place in that the displayed gradation image is undesirably affected by the pulse except for the writing pulses also arises by the other pulse immediately after the writing pulse has been applied. In a case where a domain wall is formed by the pulse (C) at the position j shown in FIG. 8, the domain wall can be sometimes translated if the pulse (for example, a voltage pulse due to an information signal at the time of no selection) following the pulse (C) has a certain voltage level. That is, there is a problem in that the displayed gradation image determined by the writing pulses can be easily subjected to a cross talk which takes place due to the influence of the ensuring pulses.

There arises another problem in that writing takes a too long time in addition to the aforesaid problems of the threshold level change and the cross talk. The reason for this lies in that the "4-pulse method" must use four pulses (A), (B), (C) and (D) in comparison to the conventional driving method in which two pulses are used to write one pixel. As a result, the time (the frame time) required to write image information on the entire surface of the panel is lengthened, causing the quality of a displayed kinetic image to deteriorate. If the worst comes to the worst, kinetic images cannot be displayed.

As described above, the "4-pulse method" encounters a problem of the error taken place when a gradation image is formed or another problem of an unsatisfactory display speed.

SUMMARY OF THE INVENTION

To this end, an object of the present invention is to provide a liquid crystal display apparatus which uses ferroelectric liquid crystal and which is capable of stably displaying an analog gradation image at high speed.

In order to overcome the aforesaid problems, according to one aspect of the present invention, there is provided a liqud crystal display apparatus comprising: a liquid crystal cell in which ferroelectric liquid crystal is disposed between two electrode substrates disposed to fact each other and an intersection portion between a scanning electrode group and an information electrode group respectively formed on the electrode substrates is made to be a pixel; scanning signal applying means; and information signal applying means, wherein the pixel has a threshold distribution with respect to a gradation information signal at the time of a scanning selection operation, the scanning signal applying means simultaneously applies scanning signals to a plurality of scanning electrodes in synchronization with an operation in which the information signal applying means applies the gradation information signal to an information electrode, and the scanning signals applied simultaneously have different waveforms.

BRIEF DESCRIPTION OF THE DRAWINGS

FIG. 9 illustrates the conventional gradation driving method;

FIGS. 10A to 10D illustrate the conventional gradation driving method;

DETAILED DESCRIPTION OF THE PREFERRED EMBODIMENTS

Figure 5:
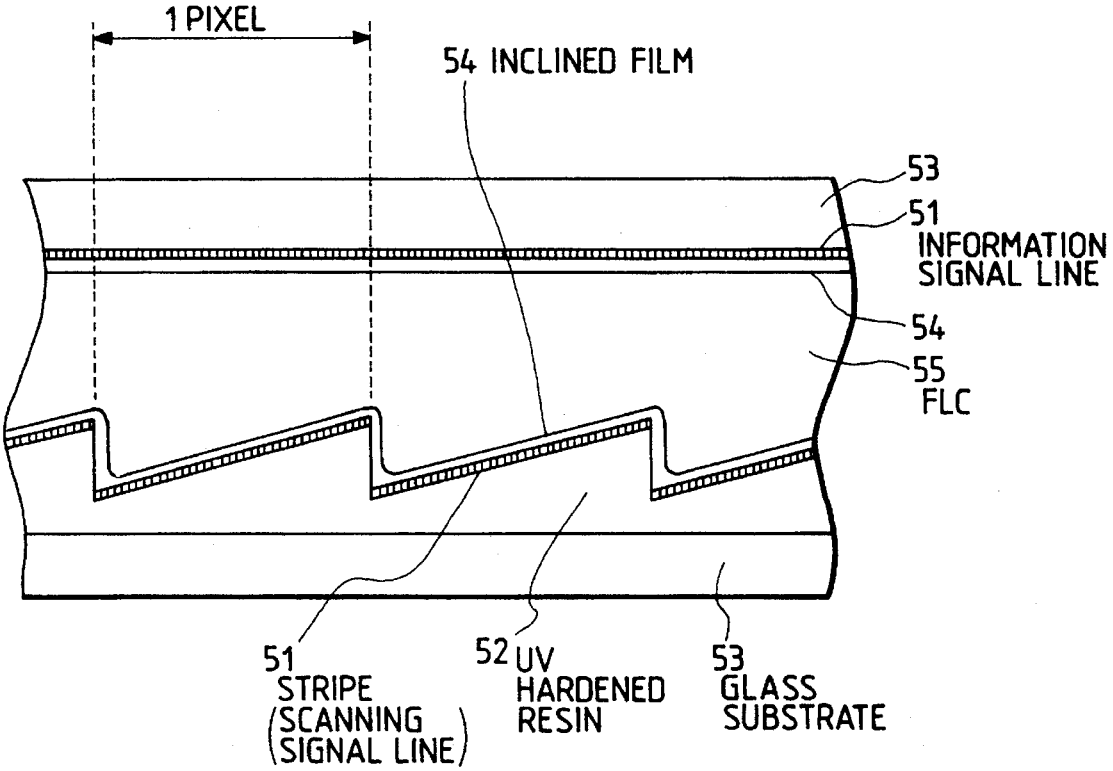
FIG. 5 is a schematic cross sectional view which illustrates a cell according to the present invention.

A liquid crystal cell adaptable to the present invention has the thresholds dispersed in one pixel thereof as shown in FIG. 5. Since the thickness of an FLC layer 55 between electrodes is changed in the cell shown in FIG. 5, the switching threshold of the FLC is also dispersed. By raising the voltage to be applied to the aforesaid pixel, switching takes place sequentially from a thinner portion.

Figure 13B:
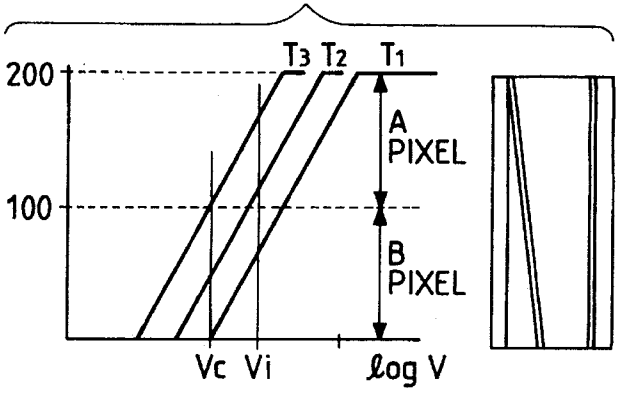
FIGS. 13A to 13D illustrate the operation of the present invention.
Figure 13A:
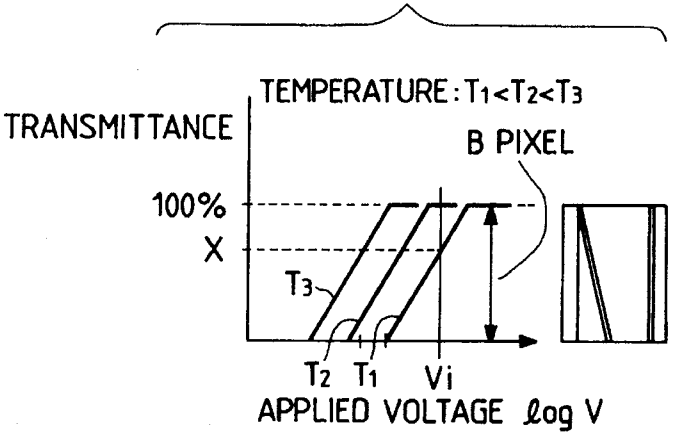

The aforesaid phenomenon is shown in FIG. 13A. Symbols $T_1$, $T_2$ and $T_3$ shown in FIG. 13A represent temperatures of portions of the panel which is being observed. The switching threshold voltage of the FLC is in inverse proportion to the temperature as illustrated in FIG. 13A, where the relationships between the applied voltages and the light transmittances at the three temperature levels are designated by three curves.

Although the threshold is changed due to factors in addition to the temperature change, the present invention will be described on the basis of a fact that the threshold is changed mainly due to the temperature change.

As can be seen from FIG. 13A, when the overall body of the pixel is reset to a dark state and voltage of $V_i$ is applied to the pixel at temperature $T_1$, transmissivity of X % can be obtained. However, if the temperature is raised to $T_2$ or $T_3$, the transmissivity is undesirably raised to 100% in the case where the same voltage $V_i$ is applied to the pixel and therefore an image having gradation cannot be displayed correctly. FIG. 13C illustrates a state where a pixel is inverted at each of the aforesaid temperature after writing has been performed. In the aforesaid state, written gradation information can be deleted due to the temperature change, causing a problem to take place in that the way of use of the display device is limited unsatisfactorily.

Figure 13D:
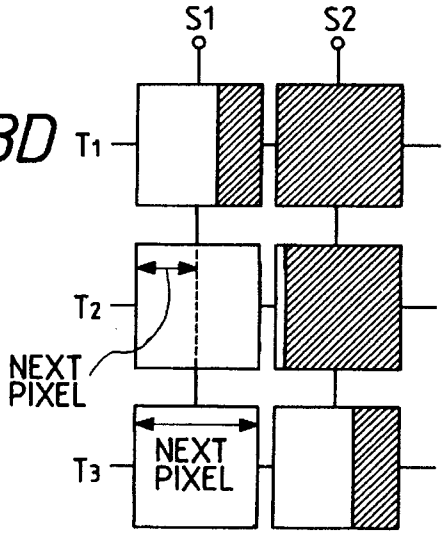
Figure 13C:
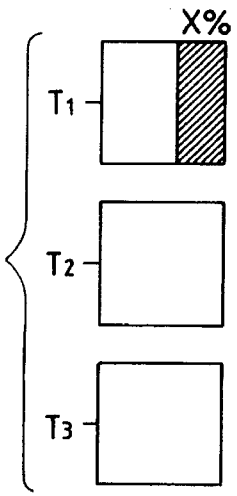

By displaying information about one pixel over two scanning signal lines $S_1$ and $S_2$ as shown in FIG. 13D, a stable gradation dispaly can be realized even if the temperature has been changed. The aforesaid driving method will now be described in detail.

(1) A ferroelectric liquid crystal cell having a pixel in which the threshold is dispersed. The liquid crystal cell may be structured as shown in FIG. 5 in such a manner that the cell thickness in the pixel is continuously changed. Another structure disclosed in Japanese Patent Application No. 62-17186 and filed by the applicant of the present invention may be employed which is arranged in such a manner that the potential is inclined in the pixel, or another structure may be employed in which the capacity is inclined in the pixel. In either of the aforesaid methods, a region (domain) corresponding to the bright state and a region (domain) corresponding to the dark state can be present while being mixed with each other so that a gradation display can be performed by utilizing the area ratio of the domains.

Although the aforesaid method may be used in the case where the light quantity is modulated in a stepped manner (for example, 16 gradations), the light quantity must be changed continuously in order to, in an analog manner, display an image of a type having gradation.

Although the description will be made about the area modulation method, the driving method according to the present invention can be adapted to a device having a pixel, the transmissive light quantity of which can be modulated by voltage or the pulse width or the like. That is, the device must have a threshold distribution which causes the continuous light quantity change to take place. An example of the device is described in Example 7.

Figures 14A, 14B:
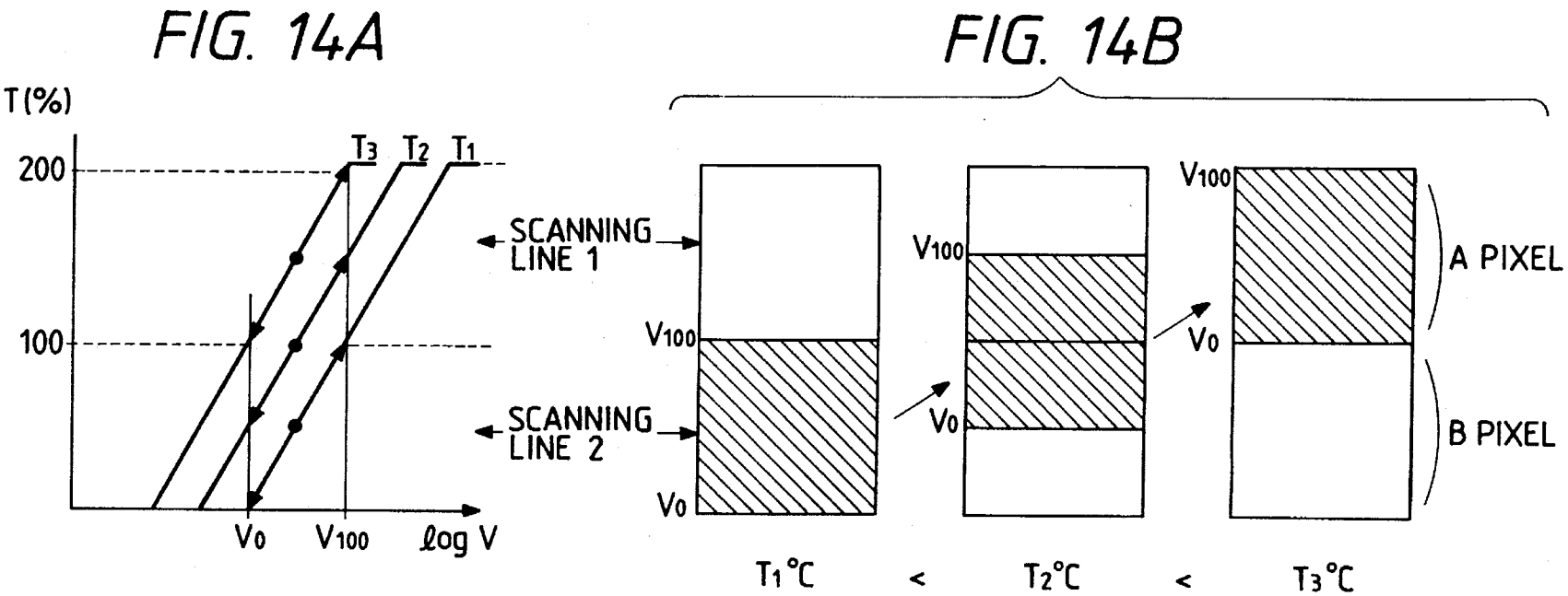
FIGS. 14A and 14B illustrate the operation of the present invention.

(2) Two scanning lines are simultaneously selected. The operation required to select the two scanning lines will now be described with reference to FIGS. 14A and 14B. FIG. 14A is a graph which illustrates the characteristics between the transmissivity and applied voltages realized when pixels on the two scanning signal lines are collected. In FIG. 14A, a portion in which the transmissivity is 0% to 100% is made to be a display region of pixel B on the scanning line 2, while a portion in which the transmissivity is 100% to 200% is made to be a display region of pixel A on the scanning line 1. That is, one pixel is constituted for each scanning signal line. Therefore, a transmissivity of 200%, in which both of the pixels A and B are brought to a complete light transmissive state, is realized when the two scanning signal lines are simultaneously scanned. In this embodiment, the two scanning signal lines are simultaneously selected with respect to one gradation information item in such a manner that a region having an area corresponding to one pixel is allocated to display one gradation information item. This arrangement will now be described with reference to FIG. 14B.

Supplied gradation information is, at temperature $T_1$, written in a range which corresponds to 0% when the applied voltage is $V_0$ and is written in a range which corresponds to 100% when the applied voltage is $V_{100}$. As can be seen from FIG. 14B, all of the aforesaid ranges (pixel regions) are present on the scanning signal line 2 at temperature $T_1$ (see a diagonal line portion of FIG. 14B). However, since the threshold voltage of the liquid crystal is lowered when the temperature has been raised from $T_1$ to $T_2$, a region larger than the region corresponding to the temperature $T_1$ is undesirably inverted in the pixel in the case where the same voltage is applied to the pixel.

In order to correct this, a pixel region corresponding to the temperature $T_2$ is set to spread over the scanning signal line 1 and the scanning signal line 2 (a diagonal line portion of FIG. 14B corresponding to the temperature $T_2$). The principle to display the pixel region to spread over the two scanning signal lines will be described later.

When the temperature has been further raised to $T_3$, the applied voltage is changed from $V_0$ to $V_{100}$ so as to set the pixel region to be drawn on only the scanning signal line 1 (a diagonal line portion of FIG. 14B corresponding to the temperature $T_3$).

By setting the pixel regions, which form an image having a gradation, on the two scanning signal lines depending upon the temperature while shifting the pixel regions, an image having a gradation can be correctly performed in the temperature range from $T_1$ to $T_3$.

(3) The scanning signals to be supplied to the two scanning signal lines, which have been selected simultaneously, are made to be different from each other. In order to compensate the threshold change at the time of the inversion of the liquid crystal due to the temperature change by simultaneously selecting the two scanning signal lines, the scanning signals to be supplied to the two selected scanning signal lines must be made different from each other. The fact will now be described with reference to FIGS. 13A to 13D.

The scanning signals to be supplied to the scanning signal lines 1 and 2 are set in such a manner that the threshold of the pixel B on the scanning signal line 2 and that of the pixel A on the scanning signal line 1 are continuously changed. Referring to FIG. 13B, the transmittance-voltage curve at the temperature $T_1$ is displayed by the region of the scanning signal line 2 when the transmittance is 100% or less, while the same is dispalyed by the region on the scanning signal line 1 when the transmittance is 200% or less. As described above, the transmittance-voltage curve must be continuously changed from the pixel B to the pixel A at the same gradient.

Therefore, if the shape of the cell for the pixel A on the scanning signal line 1 and that for the pixel B on the scanning signal line 2 (refer to FIG. 15B) are made to be the same, a display substantially the same as that realized when a continuous threshold characteristics are given to the pixels A and B (the cell shown in FIG. 13B) can be performed.

Then, a method for causing the thresholds of the pixels A and B to be continuously changed by utilizing the change of the thickness of the cell as shown in FIG. 5 will now be described.

In the case where the thickness of the cell in one pixel is changed from $d_1$ (the thinnest portion) to $d_2$ (the thickest portion), an image having a gradation can be displayed by making the width of the voltage pulse applied to the pixel B to be $\Delta T_B$ and making the width of the voltage pulse applied to the pixel A to be $\Delta T_A$ ($<\Delta T_B$) and by making the voltages of the voltage pulses applied to the pixels A and B to be the same. The aforesaid process in which the voltages are made to be the same and the pulse width are made to be different as described above can be performed because the voltage supplied to the pixel is determined by the potential difference between the scanning signal line and the information signal line.

When the aforesaid voltage is raised gradually, the area of the inverted region due to switching is increased from the portion $d_1$ (the thinnest portion) to the portion $d_2$ (the thickest portion). The switching operation in the pixel A can be inhibited by setting $\Delta T_A$ to be an adequate value which is smaller than $\Delta T_B$.

After the inversion region due to switching has been widened to the portion $d_2$ (the thickest portion) of the pixel B by further raising the voltage, the aforesaid $\Delta T_A$ can be set so as to cause switching to be commenced in the pixel A. As a result of the aforesaid setting, the inversion region is widened to the portion $d_2$ (the thickest portion) of the pixel A when the voltage is further raised.

As can be understood from the above made description, the continuity of the thresholds enabling the pixel A to start switching when the pixel B has been switched can be realized by adequately setting $\Delta T_A$ and $\Delta T_B$.

A method of determining $\Delta T_A$ and $\Delta T_B$ enabling the aforesaid continuity of the thresholds to be realized will now be described with reference to FIG. 16.

Figure 16:
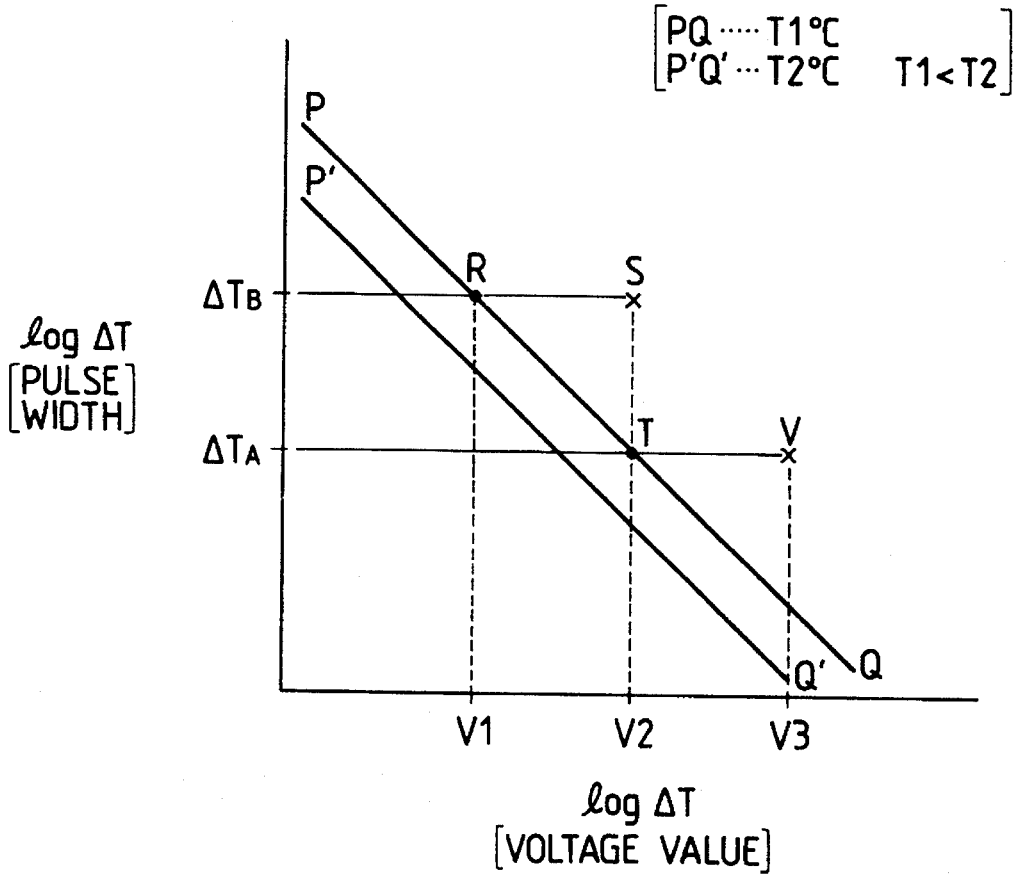
FIG. 16 illustrates a compensating method according to the present invention.

FIG. 16 is a graph which illustrates the relationship between the voltage pulses to be applied to a pixel of the ferroelectric liquid crystal device structure as shown in FIG. 5 and the voltage, where the axis of ordinate stands for the logarithm of the pulse width and the axis of abscissa stands for the logarithm of the voltage so as to show the conditions which enable the portion having the cell thickness $d_1$ (the thinnest portion) to be switched.

Referring to FIG. 16, switching of the ferroelectric liquid crystal takes place when a voltage pulse indicated by an arbitrary point positioned to the right of segment PQ (pulse width-voltage curve) at the temperature $T_1$ is applied to the pixel. However, the voltage pulse indicated by a point positioned to the left of a straight line PQ does not cause switching to take place.

When the voltage is gradually raised while fixing the pulse width to $\Delta T_B$ on the aforesaid graph, the portion of the pixel B having the cell thickness of $d_1$ is switched at the voltage $V_1$ (under condition of point R). With the rise of the voltage, the inversion region due to switching is gradually expanded, and the portion having the cell thickness of $d_2$ of the pixel B is switched when the voltage has been raised to $V_2$ (under condition of point S). It is preferable to make the pulse width to be $\Delta T_A$ (under condition of point T) to be applied to the pixel A so as to cause the portion of the pixel A having the cell thickness of $d_1$ to be switched first. When the voltage is raised to $V_3$ (under condition of point U), the inversion region is expanded to the portion of the pixel A having the cell thickness of $d_2$.

It should be noted that both of $V_2/V_1$ and $V_3/V_2$ depend upon the shape of the cell (the distribution of the cell thickness). As a result of the aforesaid characteristics and a fact that the transmittance of the pixel is in proportion to the area of the inversion region, the transmittance-voltage curve of the pixel A and that of the pixel B hold a relationship which are mutually translated in parallel on the graph in which the voltage axis is indicated by the logarithm. That is, the transmittance-voltage curve as shown in FIG. 13B is obtained.

The pulse width-voltage curve shown in FIG. 16 indicates the cahracteristics of the material of the liquid crystal, the pulse width-voltage curve being translated in parallel depending upon the temperature in a graph in which a straight line P'Q' is shown. Assuming that straight line PQ indicates the characteristics realized at temperature $T_1$ and straight line P'Q' indicates the characteristics realized at temperature $T_2$, a relationship $T_1<T_2$ is held.

In the case where an image having gradation is displayed, voltage ranged from $V_1$ to $V_2$ is, in accordance with gradation information, applied to a panel, the lowest temperature of which is $T_1$. That is, $V_1$ is the voltage corresponding to the case where information is written by 0% and $V_2$ is the voltage corresponding to the case where information is written by 100%.

In the case where $V_{OP}$ ($V_1<V_{OP}<V_2$) is applied to the scanning signal lines 1 and 2, a required gradation level is written on the scanning signal line 2 by the pulse having the pulse width $\Delta T_B$ in the portion of the panel, the temperature of which is $T_1$. However, overwriting on the scanning signal line 2 takes place because the portion of the panel, the temperature of which is $T_2$, is switched at low voltage as can be understood from FIG. 16. Another problem takes place in that information is written on the overall portion on the scanning signal line 2. However, a writing method which enables an image having gradation to be displayed in a substantially correct manner in which the writing region is shifted from the scanning signal line 2 to the scanning signal line 1 by writing information on the scanning signal line 1 in response to the pulse having the width $\Delta T_A$ to correct the overwritten portion on the scanning signal line 2.

Then, the state in which the pixel is turned on/off in the aforesaid writing operation will now be described with reference to FIGS. 17A~17C and 18.

Figure 17A:
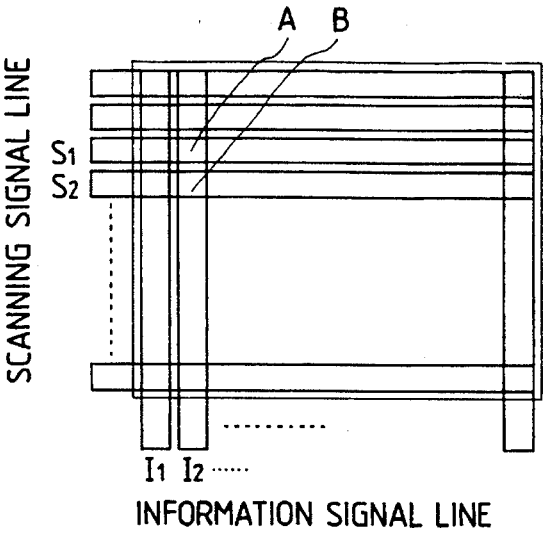
FIGS. 17A to 17C illustrate the compensating method according to the present invention.

FIG. 17A illustrates an example of the structure of electrodes of a liquid crystal cell which can be operated in the matrix manner, where symbols $S_1$, $S_2$, . . . , represent scanning signal lines and $I_1$, $I_2$, . . . , represent information signal lines.

Figure 17B:
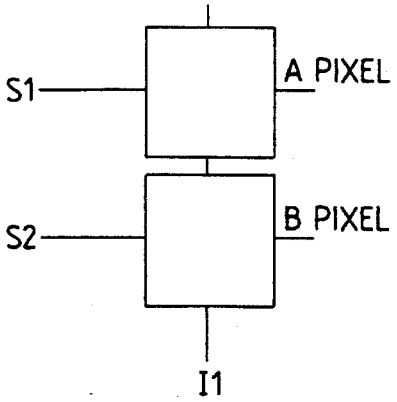

FIG. 17B is an enlarged view which illustrates the pixels A and B.

Figure 17C:
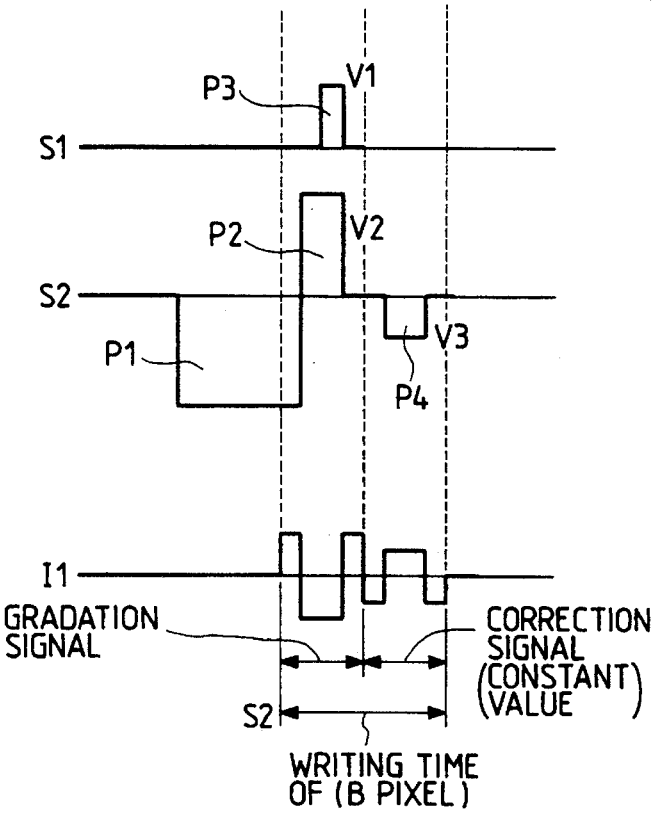

FIG. 17C illustrates an example of a signal to be written on the pixels A and B.

Figure 18:
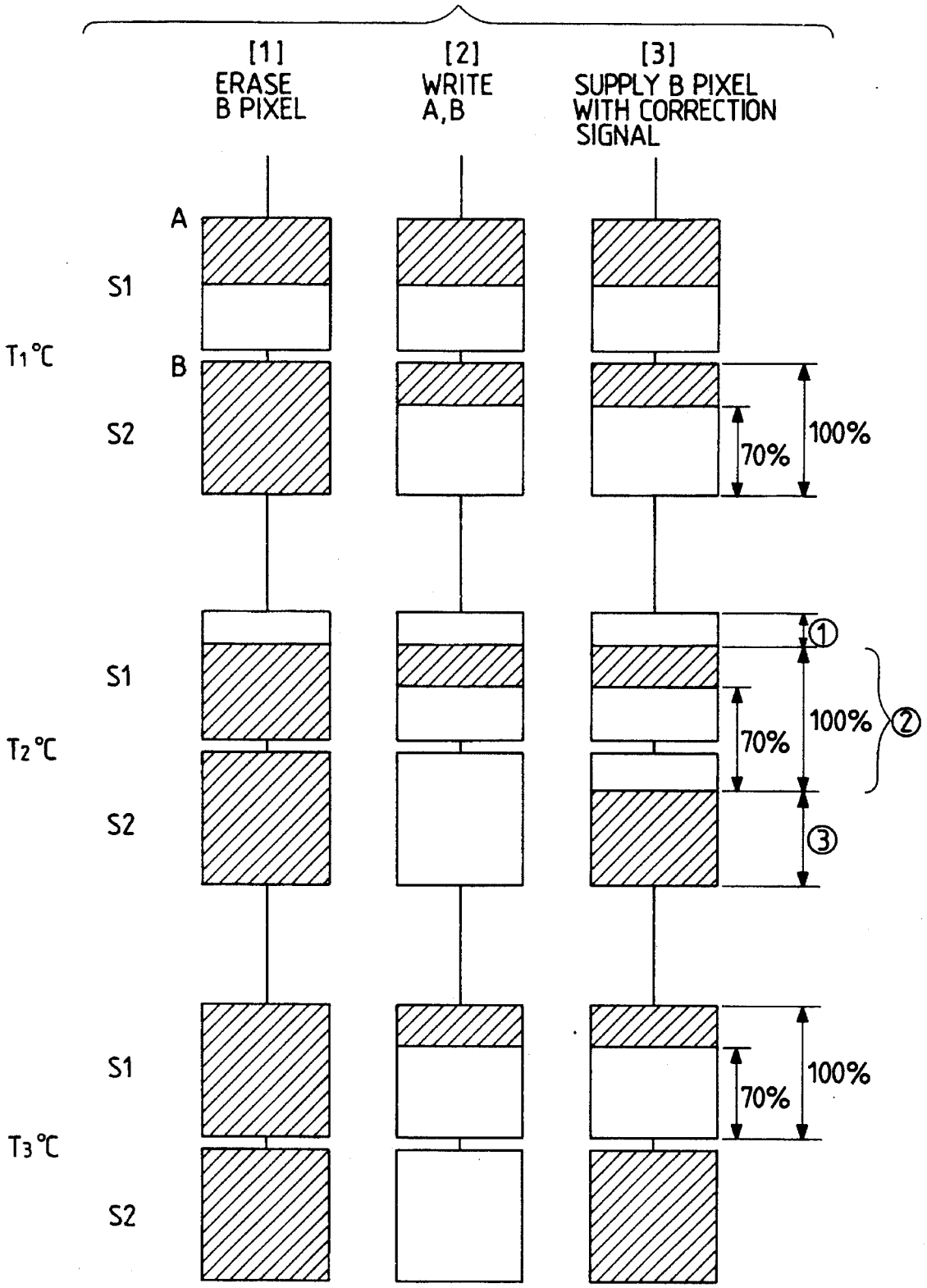
FIG. 18 illustrates the compensating method according to the present invention.

FIG. 18 illustrates a process of writing on the pixels A and B in an order of [1]+[2]+[3] at the temperatures $T_1$, $T_2$ and $T_3$ ($T_1<T_2<T_3$).

The operation of writing information on the pixel while simultaneously scanning $S_1$ and $S_2$ shown in FIG. 17 will now be described.

First, writing information on the pixel at the temperature $T_1$ will now be described.

[1] The pixel B is deleted by pulse $P_1$ shown in FIG. 17C (the dark state is realized).

[2] Information is written to the pixel A and B by pulses $P_3$ and $P_2$, respectively (a 70% bright state according to this example). However, the pixel A is not changed at temperature $T_1$ because the voltage of the pulse $P_3$ is lower than the threshold with respect to the threshold.

Figure 12:
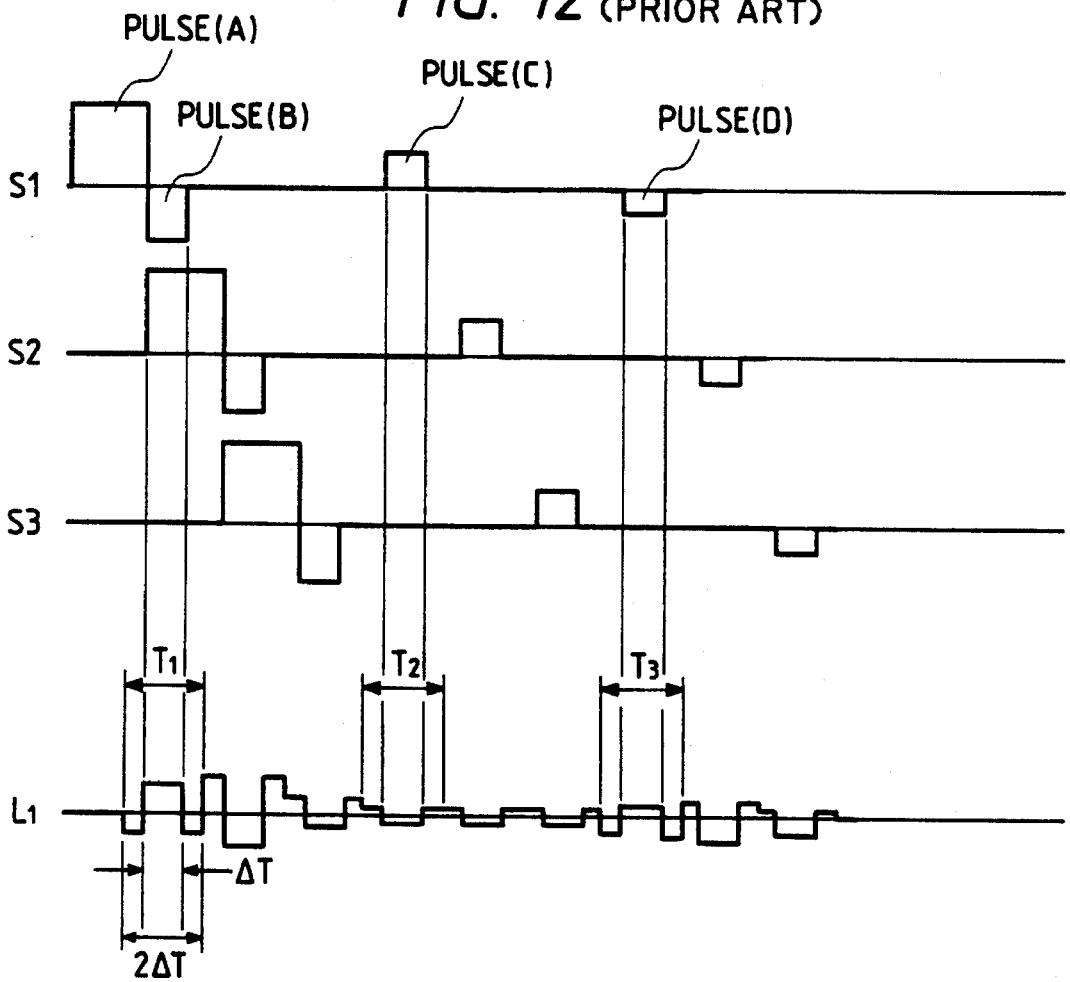
FIG. 12 (PRIOR ART)
FIG. 12 illustrates waveforms in the conventional gradation driving method.

[3] A correction signal is supplied to the pixel B by the pulse $P_4$ (the pulse $P_4$ has a similar function as that of the pulse (c) used in the 4-pulse method shown in FIG. 12). However, the pixel B is not changed from the previous stage [2] at temperature $T_1$ (the 70% bright state is maintained).

As described above, an image gradation can be correctly displayed (the 70% bright state) at temperature $T_1$.

Then, an operation of writing information on the pixel at temperature $T_2$ will now be described.

In the state where the temperature is $T_2$, also the pixel A on the scanning signal line S1 is in the state where its thresholds being changed.

[1] The pixel B is deleted (it is brought into the dark state).

[2] Information is written on the pixels A and B by the pulses $P_3$ and $P_2$. The pixel B is completely written at temperature $T_2$ (the pixel B is brought to the complete bright state). Also a portion (a bright portion) is formed in the pixel A, to which information is written, in accordance with the relationship between the pulse and the threshold.

[3] A correction pulse $P_4$ is applied to the pixel B. A portion of the pixel B on the scanning signal line $S_2$ is deleted by a degree corresponding to the drop of the threshold due to the temperature change. The deleted portion is used for the next line writing.

Observing the pixels A and B (FIG. 18 [3]at temperature $T_2$), it can be understood that portions ①, ② and ③ for indicating gradation information are present on the two scanning signal lines $S_1$ and $S_2$.

The portion ① is a portion which indicates a portion of gradation information corresponding to the scanning signal line ($S_1$) in front of the scanning signal line $S_2$.

The portion ② is a portion which indicates a portion (the 70% bright state similarly to temperature $T_1$).

The portion ③ is a portion on the scanning signal line ensuing the scanning signal line $S_2$ in which information is (or has been) written.

Then, an operation of writing information on the pixel the temperature of which is $T_3$ will now be described.

[1] The pixel B is deleted (is brought to the dark state ).

[2] Information is written on the pixels A and B by the pulses $P_3$ and $P_2$.

[3] The correction signal pulse $P_4$ is supplied to the pixel B.

All of gradation information to be written to the pixel B on the scanning signal line $S_2$ is shifted to the pixel A on the scanning signal line $S_1$ at temperature T3. Also in this case, the gradation display has, of course, been brought to the 70% bright state.

As a result of the aforesaid principle, an image gradation can be displayed while compensating the threshold change taken place due to the temperature change. Furthermore, the polarity of the pulses of the aforesaid scanning signals can be inverted in such a manner that the adjacent scanning signal lines have opposite polarities.

Then, a method of driving the scanning signal lines for causing the adjacent scanning signals have opposite polarities will now be described.

Figure 26B:
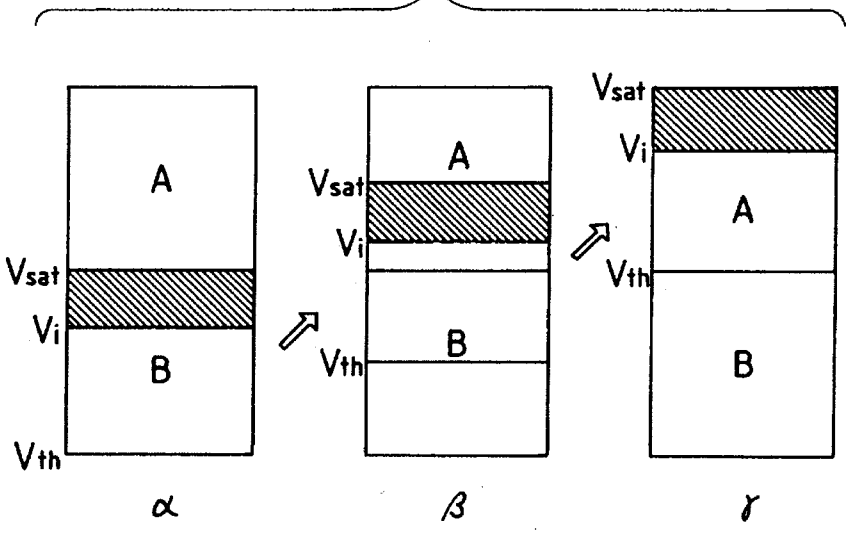
FIGS. 26A and 26B illustrate the compensating method according to the present invention.

First, a method of compensating the threshold change will now be described briefly with reference to FIG. 26A and 26B. Assumptions are made here that the transmittance when one pixel is completely bright (white) is 100% and that when the one pixel is completely dark (black) is 0%.

Figure 26A:
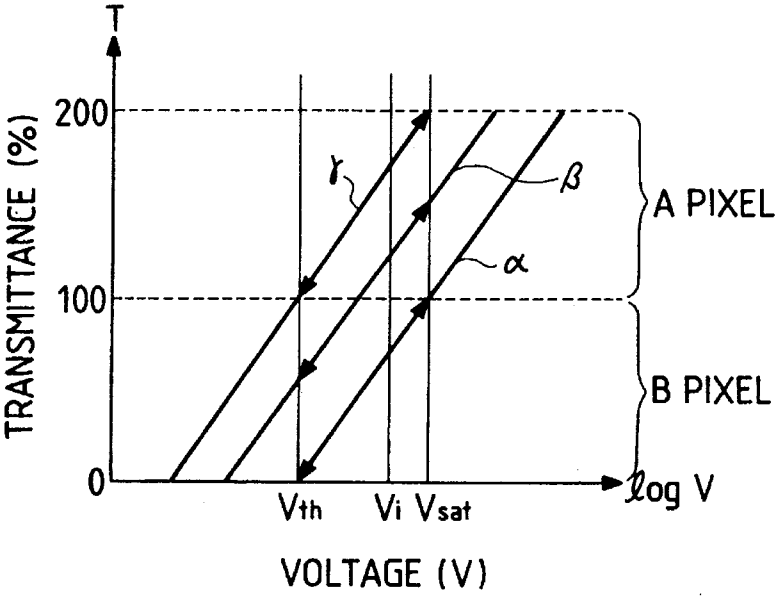

FIG. 26A is a graph in which two pixels A and B are used, and the threshold characteristics with respect to information voltage V are continuously illustrated. As a result, the writing region with information voltage $V_i$ ($V_{th}<V_i<V_{sat}$) is not saturated as shown in FIG. 13B even if the reference threshold characteristics $\alpha$ has been changed to $\beta$ or $\gamma$ due to the temperature change or the like. Hence, the region to which information can be written at $V_{sat}$ but to which information cannot be written at $V_{th}$ is translated from the pixel B to the pixel A. That is, possession of a display region corresponding to one information signal over a plurality of pixels having the continued threshold characteristics will compensate the dispersion of the threshold characteristics.

Then, this method will now be described in detail.

(1) A ferroelectric liquid crystal cell having the threshold which is continuously changed in the pixel thereof is prepared. The structure as shown in FIG. 5 may be employed in which the thickness of the cell is continuously changed in the pixel. As an alternative to this, a structure may be employed in which the potential is inclined in the pixel, or another structure may be employed in which the capacity is inclined.

(2) The threhsold characteristics of the two pixels are made to be continuous in response to an information signal. In order to make the threshold characteristics to be continuous by simultaneously selecting the two scanning lines in response to the information signal, the two selection pulses must be different from each other.

Figures 15A, 15B, 15C:
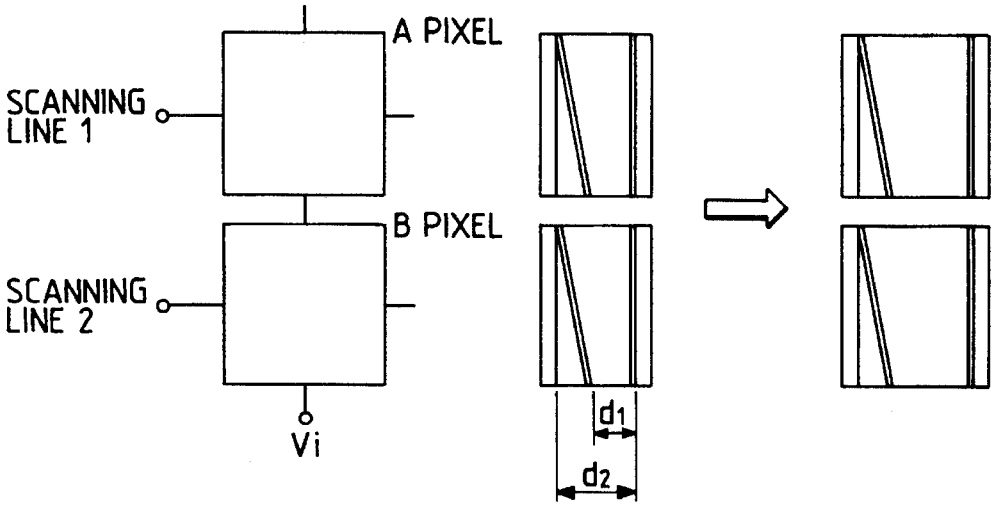
FIGS. 15A to 15E illustrate the operation of the present invention.

In the case where a method of realizing the threshold change in the pixel is arranged in such a manner that the change of the thickness of the cell as shown in FIG. 15B is employed, the width of the pulse of the voltage to the pixel B is made to be $\Delta T_B$ and that of the pulse of the voltage to be pixel A is made to be $\Delta T_A$ so as to change the thickness of the cell in one pixel from $d_1$ (the thinnest portion) to $d_2$ (the thickest portion). The same voltage $V_i$ is applied to the pixels A and B.

By gradually raising the voltage $V_i$ afterwards, the switching region of the FLC is enlarged from the $d_i$ portion of the pixel B toward the portion $d_2$. However, switching is not taken place in the pixel A because the pulse width $\Delta T_A$ is made to be smaller than the pulse width $\Delta T_B$ to be applied to the pixel B. However, the portion of the pixel A having the cell thickness $d_1$ starts switching when the switching region has been expanded to the portion of the pixel B having the cell thickness of $d_2$ and the voltage has been further raised. Also the portion of the pixel A having the cell thickness $d_2$ then starts switching, so that the apparent thickness with respect to the voltage $V_i$ can be made as shown in FIG. 15C.

As can be understood from the above made description, the conditions required for the pixel A to start switching when the pixel B has been completely switched depend upon the selection of the pulse width. The method of determining the pulse widths $\Delta T_A$ and $\Delta T_B$ is the same as the aforesaid method described with reference to FIG. 16.

(3) A display region corresponding to one information signal is changed by the change of the threshold characteristics.

An example of the writing signals for use to write information and a state where the pixel is turned on/off are shown in FIGS. 17A~17C and 18. Referring to FIG. 17, symbol $P_1$ represents a reset pulse, $P_2$ represents a first selection pulse, $P_3$ represents a second selection pulse, and $P_4$ represents a correction pulse. The first and the second pulses $P_2$ and $P_3$ are set so as to cause the threshold characteristics of the pixel A and those of the pixel B to be continuous. Symbol $Q_2$ is a correction signal which synchronizes with the correction pulse $P_4$.

(4) The adjacent scanning electrodes are arranged in such a manner that the polarities of the pulses of each pulse of the scanning signal waveform to be applied are inverted.

The function of the pulses $P_2$ and $P_4$ shown in FIG. 17C is to, if necessary, contrarily write (bring the state into the dark state) the pixel which has been written excessively (the bright state has been excessively widened) corresponding to the change of the temperature.

However, the aforesaid pulse can be omitted by inverting the direction of the electric field of the pulse for deleting the adjacent scanning line and by inverting the direction of the writing electric field (for example, the portion written to be white is written to be black. A process of writing to be white by 70% after the portion has been written to be black and a process of writing to be black by 30% after the portion has been deleted to be white cause the pixel to be the same transmissive state).

The pulse $P_4$ is a pulse for rewriting the area corresponding to the portion, which has been written excessively, in the same direction of the electric feild as the direction in which the next line to be written, and it becomes unnecessary if the electric field for use in the deleting process is alternately changed in the adjacent scanning lines. That is, the necessity of the correction can be eliminated because the direction of the electric field in the case of excessively writing can be made coincide with the direction of the electric field for deleting the next line by alternately changing the direction of the electric field for use deleting process for each scanning line.

As described above, the time required to write an image can be further shortened by omitting the pulses $P_4$ and $Q_2$ shown in FIG. 17C from the operation sequence.

(5) The scanning signal line is selected two times for one frame.

The driving method shown in FIG. 17C is arranged in such a manner that the two scanning lines $S_1$ and $S_2$ are selected to write one pixel because the temperature characteristics of the FLC material must be corrected. In order to write all of the pixels, one scanning line is selected two times in one frame period.

The two times of the scanning operation is performed so as to compensate the temperature of the next line (the pulse $P_3$) by the first scanning operation and to write the subject line (the pulses $P_1$ and $P_2$).

By the aforesaid principle and the driving methods, image gradation can be displayed while compensating the threshold change taken place due to the temperature change or the like. Then, a driving method which uses the principle of the drive according to the present invention and in which the pulse width of the information signal waveform is changed in accordance with gradation information, and another driving method in which the phase of the information signal waveform will now be described.

Figures 15D, 15E:
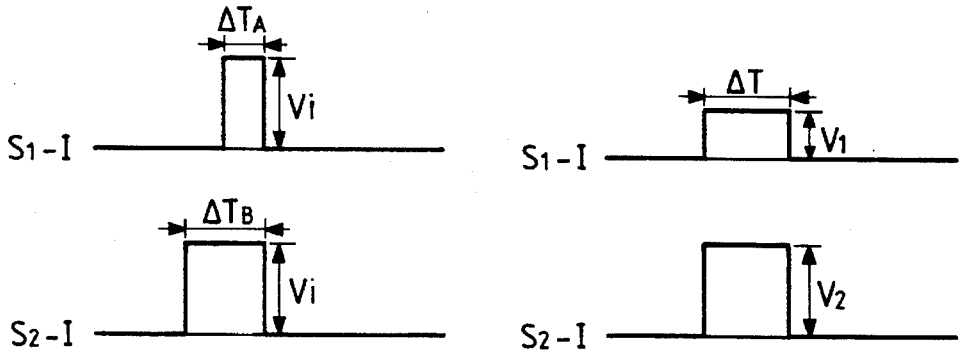

As a method of forming the threshold distribution in the pixel, the voltage of the pulse to be applied to the pixel B is set to be $V_2$ and the voltage to be applied to the pixel A is set to be $V_1$, as shown in FIG. 15E, when the change of the cell thickness in one pixel is changed from $d_1$ (the thinnest portion) to $d_2$ (the thickest portion) as shown in FIG. 15B.

By gradually widening the width $\Delta T$ of the aforesaid pulse, the area of the inversion region due to switching is increased from the portion of the pixel B having the thickness $d_1$ (the thinnest portion) toward the portion having the thickness $d_2$ (the thickest portion). On the other hand, switching of the pixel A can be prevented by setting the voltage $V_1$ to a small value lower than the voltage $V_2$ to be applied to the pixel B.

The aforesaid voltage $V_1$ can be set to a level which causes the pixel A to start switching after the inversion region due to switching has been expanded in the pixel B to the portion having the thickness $d_2$ (the thickest portion) by further raising the voltage. As a result of the aforesaid setting, the pulse width can be further widened and the inversion region can be expanded to the portion of the pixel A having the thickness $d_2$ (the thickest portion).

As can be understood from the aforesaid descriptions, the continuity of the threshold can be realized which enables the pixel A to start switching after the pixel B has been completely switched. That is, the cell thickness with respect to the pulse width $\Delta T$ can be made as shown in FIG. 15C.

A method of determining $V_1$ and $V_2$ which enable the aforesaid continuity of the threshold to be realized will now be described with reference to FIG. 16.

FIG. 16 illustrates the similar factors to the above made description. When the pulse voltage is fixed to $V_2$ and the pulse width $\Delta T$ is gradually widened on the aforesaid graph, the portion of the pixel B having the thickness $d_1$ is switched when the pulse width is $\Delta T_A$ (under the conditions of point T). With the enlargement of the pulse width, the inversion region due to switching is gradually enlarged, and the portion of the pixel B having the thickness $d_2$ is switched when the pulse width is enlarged to $\Delta T_B$ (under the condition of point S). It is preferable to set the voltage $V_1$ of the pulse to be applied to the pixel A to a level (under the condition of point R) which enables the portion of the pixel A having the thickness $d_1$ to start switching.

It should be noted that both of $V_2/V_1$ and $V_3/V_2$ depend upon the shape of the cell (the distribution of the cell thickness).

The state where the pixel is turned on/off during the aforesaid writing operation will now be described with reference to FIGS. 18 and 31A~31C.

Figure 31A:
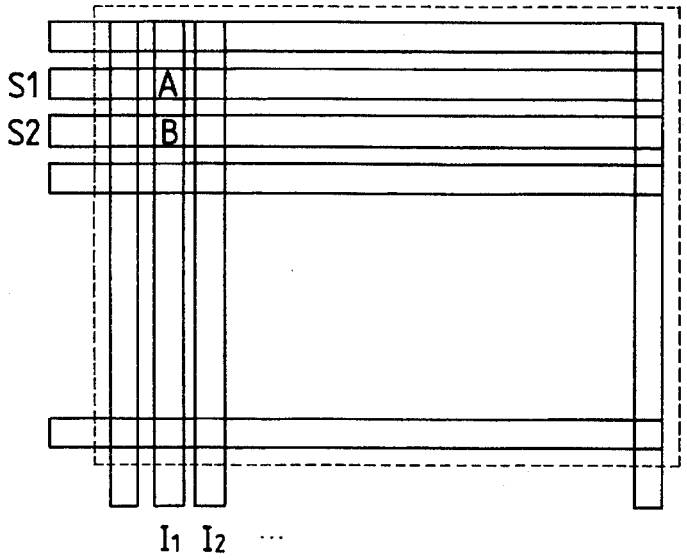
FIGS. 31A to 31C illustrate the compensating method according to the present invention.

FIG. 31A illustrates an example of the structure of electrodes of a liquid crystal cell which can be operated in the matrix manner, where symbols $S_1$, $S_2$, . . . , represent scanning signal lines and $I_1$, $I_2$, . . . , represent information signal lines.

Figure 31B:
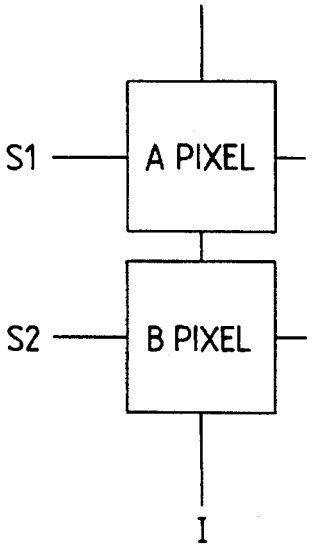

FIG. 31B is an enlarged view which illustrates the pixels A and B.

Figure 31C:
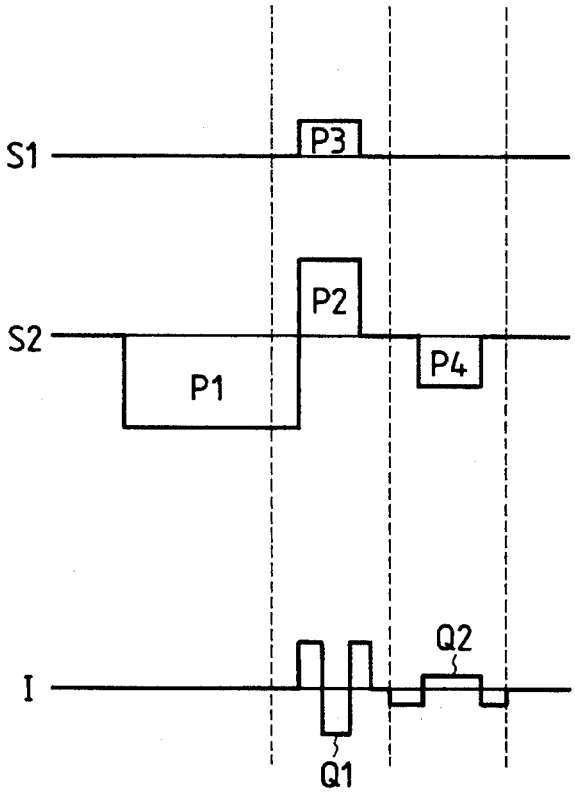

FIG. 31C illustrates an example of a signal to be written on the pixels A and B.

FIG. 18 illustrates a process of writing on the pixels A and B in an order of [1]+[2]+[3] at the temperatures $T_1$, $T_2$ and $T_3$ ($T_1<T_2<T_3$).

A pixel writing operation while making $S_1$ and $S_2$ shown in FIGS. 31A~31C to be the scanning lines which perform the simultaneous operation will now be described.

First, a pixel writing operation to be performed at the temperature $T_1$ will now be described.

[1] The pixel B is deleted by the pulse $P_1$ (the dark state is realized).

[2] Writing of the pixels A and B is performed by pulses $P_1$ and $P_2$, respectively (a 70% bright state in this example.). However, the pixel A is not changed because the voltage formed by the pulses P3 and Q1 is lower than the threshold with respect to the pixel A.

[3] A correction signal realized by the pulses $P_4$ and $Q_2$ is applied to the pixel B. The pixel B on the signal line $S_2$ is deleted (is brought to the dark state) by the area corresponding to the reduction of the threshold due to the temperature. The deleted portion is used in the next writing process.

Observing the pixels A and B (FIG. 18 [3] at temperature $T_2$) which have been subjected to the writing operation, it can be understood that portions ①, ② and ③ for indicating gradation information are present on the two scanning signal lines $S_1$ and $S_2$.

The portion ① is a portion which indicates a portion of gradation information corresponding to the scanning signal line ($S_1$) in front of the scanning signal line $S_2$.

The portion ② is a portion which indicates gradation information (the 70% bright state similarly to temperature $T_1$) corresponding to the signal line $S_2$.

The portion 3 is a portion on the scanning signal line ensuing the scanning signal line $S_2$ in which information is (or has been) written.

Then, an operation of writing information on the pixel the temperature of which is $T_3$ will now be described.

[1] The pixel B is deleted (is brought to the dark state).

[2] Information is written on the pixels A and B by the pulses $P_1$ and $P_2$.

[3] The correction signal pulse $P_4$ is supplied to the pixel B.

All of gradation information to be written to the pixel B on the scanning signal line $S_2$ is shifted to the pixel A on the scanning signal line $S_1$ at temperature $T_3$. Also in this case, the gradation display has, of course, been brought to the 70% bright state.

As a result of the aforesaid principle, an image gradation can be displayed while compensating the threshold change taken place due to the temperature change. Furthermore, the polarity of the pulses of the aforesaid scanning signals can be inverted in such a manner that the adjacent scanning signal lines have opposite polarities.

However, the aforesaid pulse can be omitted by inverting the direction of the electric field of the pulse for deleting the adjacent scanning line and by inverting the direction of the writing electric field (for example, the portion written to be white is written to be black. A process of writing to be white by 70% after the portion has been written to be black and a process of writing to be black by 30% after the portion has been deleted to be white cause the pixel to be the same transmissive state).

The pulse $P_4$ is a pulse for rewriting the area corresponding to the portion, which has been written excessively, in the same direction of the electric field as the direction in which the next line to be written, and it becomes unnecessary if the electric field for use in the deleting process is alternately changed in the adjacent scanning lines. That is, the necessity of the correction can be eliminated because the direction of the electric field in the case of excessively writing can be made coincide with the direction of the electric field for deleting the next line by alternately changing the direction of the electric field for use in the deleting process for each scanning line.

As described above, the time required to write an iamge can be further shortened by omitting the pulses $P_4$ and $Q_2$ shown in FIG. 31C.

The scanning signal line is selected two times for one frame.

The driving method shown in FIG. 31C is arranged in such a manner that the two scanning lines $S_1$ and $S_2$ are selected to write one pixel because the temperature characteristics of the FLC material must be corrected. In order to write all of the pixels, one scanning line is selected two times in one frame period.

The two times of the scanning operation is performed so as to compensate the temperature of the next line (the pulse $P_3$) by the first scanning operation and to write the subject line (the pulses $P_1$ and $P_2$).

In each of the aforesaid driving method, the scanning lines $S_1$ and $S_2$ are not sufficient to express the image gradation due to a fact that the temperature has been raised to a level higher than $T_3$ or another fact. However, a correct display of image gradation can be realized while compensating the threshold change by using three or more scanning lines and performing driving based on a similar principle.

Examples (Example 1)

A liquid crystal cell having a cross sectional shape as shown in FIG. 5 was manufactured as Example 1. The sawtooth shape of the lower substrate shown in FIG. 5 was manufactured in such a manner that a pattern was formed on a mold and it was transferred to the upper surface of the glass substrate by using an acrylic UV setting resin 52. On the sawtooth shape (52) made of the UV setting resin 52, an ITO film was formed as a stripe electrode 51 by sputtering. Then, oriented film LQ-1802 manufactured by Hitachi Kasei was formed on the stripe electrode 51 so as to serve as a directed film 54 to have a thickness of about 300 Å.

The cell substrate place to oppose it was formed by an oriented film on the stripe electrode 51, the cell substrate having no projections and pits.

The upper and the lower substrates were rubbed in parallel and the cell was constituted in such a manner that the direction, in which the lower substrate was rubbed, was deflected by about 6° in the right-handed screw direction from the direction in which the upper substrate was rubbed. The cell thickness was controlled so as to make the thin portion to have a thickness of about 1.0 μm and to make the thick portion to have a thickness of about 1.4 μm. Furthermore, the stripe electrode 51 of the lower substrate was patterned into a stripe shape along the rib so that one side of the sawtooth was made to be one pixel.

The width of the stripe electrode 51 was made to be 300 μm and the pixel was formed into a rectangular having a size 300 μm×200 μm.

Used materials of the liquid crystal are shown Table 1.

TABLE 1

| Liquid Crystal A | |
|---|---|
| Iso $\xrightarrow{82.3^\circ C.}$ Ch $\xrightarrow{76.6^\circ C.}$ SmA* $\xrightarrow{54.8^\circ C.}$ SmC* (Iso ← Ch: 81.8° C.; Ch → SmA*: 77.3° C.; SmC* → SmA*: −2.5° C.; SmC* → Cryst: −20.9° C.) | |
| Ps = 5.8 nC/cm$^2$, Ps < 0 | 30° C. |
| Tilting angle = 14.3° | 30° C. |
| $\Delta\epsilon \sim -0$ | 30° C. |

The threshold of the liquid crystal was 11.5 volt/μm (80 μS pulse at 25° C.), and the threshold of each pixel was 11.5 to 16.1 volt (80 μS pulse at 25° C.).

Figure 1:
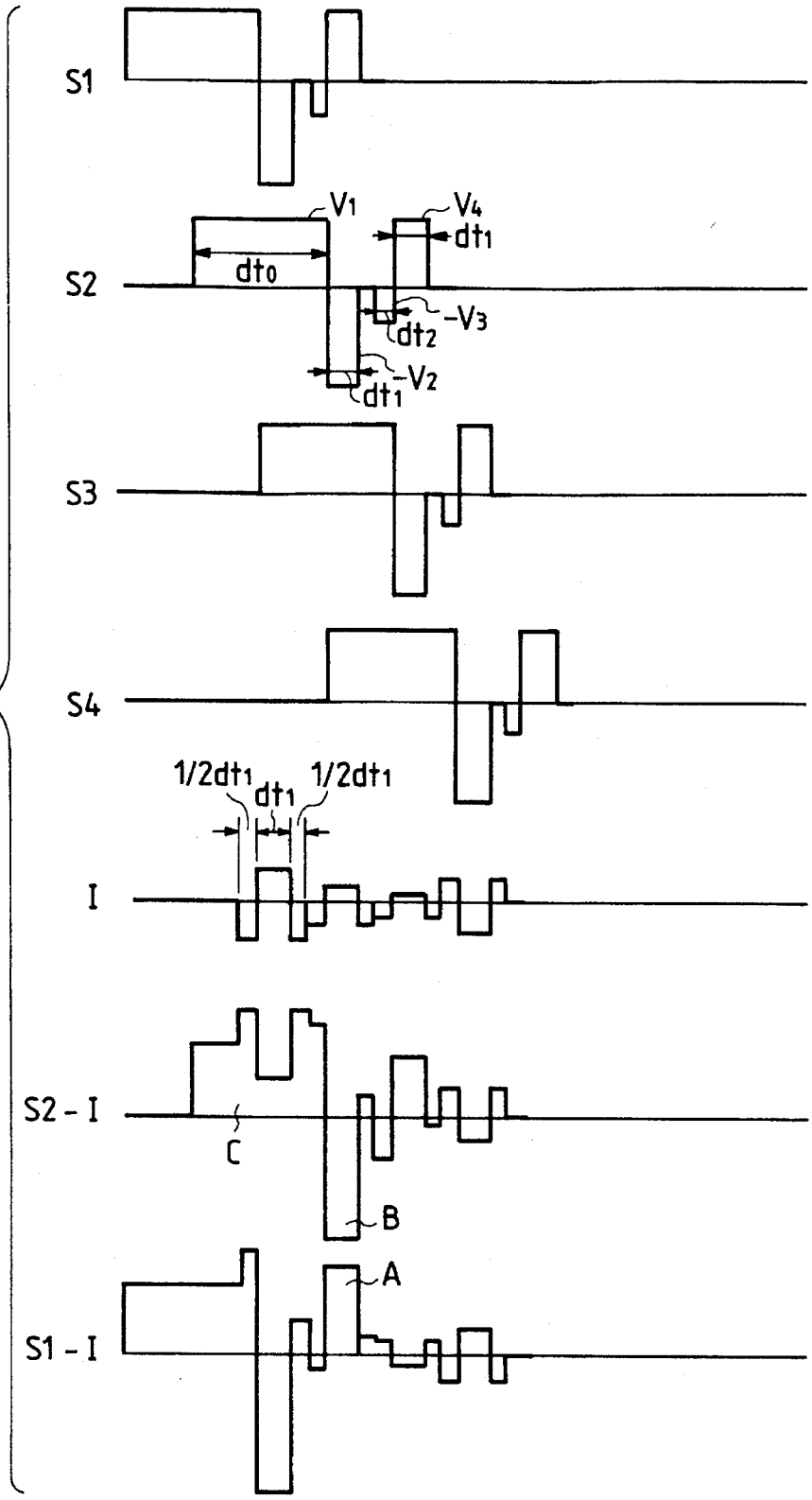
FIG. 1 illustrates driving waveforms according to Example 1.

FIG. 1 illustrates driving waveforms.

Referring to FIG. 1, symbols S1 to S5 represent scanning signal waveforms and I represents an information signal waveform.

Figure 20:
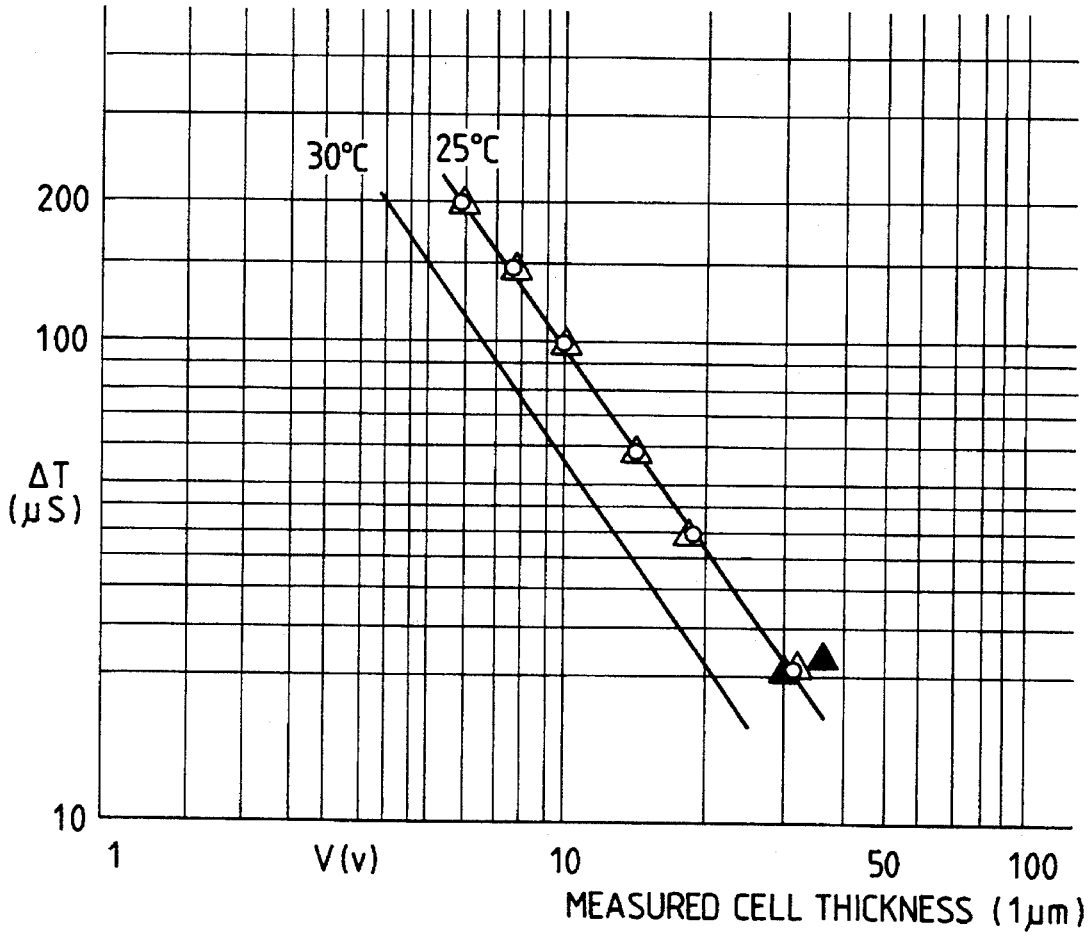
FIG. 20 is a graph which illustrates curves indicating the DT-V characteristics of liquid crystal materials according to Examples 1 to 6.

The distribution of the temperature of the liquid crystal pulse was restricted to a range from 25°–30° C. A ΔT (pulse width)–V (voltage) curve at this time is shown in FIG. 20 (the characteristics realized in a 1 μm cell).

The pulse width and the voltage level of each pulse shown in FIG. 1 were set as follows:

$dt_0$=240 μs $dt_1$=80 μs $dt_2$=49.5 μs $dt_3$=30.5 μs $V_1$=10.0 volt $V_2$=10.0 volt $V_3$=3.22 volt $V_4$=7.1 volt The information signal Vi is determined by the following equation. In the case of X %, $$Vi = -10\left(\frac{X}{100}\cdot\log\frac{16.1}{11.5}\right)\cdot 11.5$$

. . . in the case where black deletion line $$Vi = 10\left(\frac{(100-X)}{100}\cdot\log\frac{16.1}{11.5}\right)\cdot 11.5$$

. . . in the case where white deletion line

Referring to FIG. 1, an electric signal to be supplied to the line S2 was represented by $S_2$-I.

Among the pulse group, waveform C indicates the deletion of the pixel (collectively written to be white or black), while ensuing waveform B indicates writing on the line $S_2$.

An electric signal to be supplied to the line $S_1$ is represented by $S_1$-I, and symbol A represents information to be written on the line $S_1$ so as to compensate the temperature of the line $S_2$.

Gradation display by the thus constituted cell and by the arranged driving waveforms, the quality of the gradation display could be improved (the temperature range could be restricted) regradless of the irregular temperature distribution (the temperature was distributed in a range from 25°–30 ° C.) in the liquid crystal panel.

With the aforesaid method, the time required to drive one frame can be shortened to one-third in comparison to the conventional 4-pulse method. Since one pixel must be subjected to writing three times after the deletion in the 4-pulse method, three times the time required in the present invention was taken.

When the deletion direction by the scanning line is made opposite in the frame, the stability of the domain wall can be improved. It can be considered that the generation of the deviation of ions in the FLC layer is prevented sufficiently.

In Example 1, a cell having projections and pits shown in FIG. 5 was used.

Figure 32:
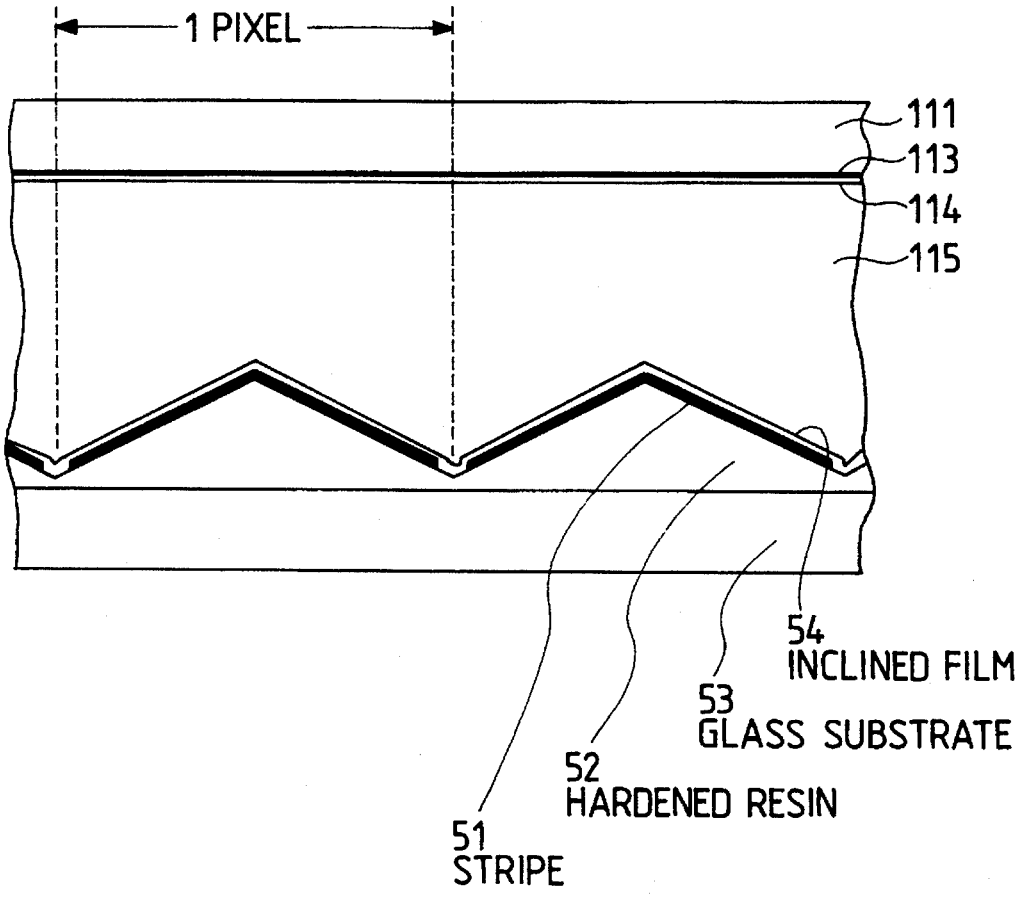
FIG. 32 illustrates the other cell structure according to Example 1.

In the structure shown in FIG. 5, one pixel is constituted by one gradient. However, another structure as shown in FIG. 32 for changing the thickness of the cell may be employed. In the case where the cell formed as shown in FIG. 5 is used, the change of the contents to be written on the pixel by the temperature change is realized by the parallel translation to the adjacent scanning line. In the case where a plurality of gradients are given in one pixel, the quality of the display was improved in a precise panel although an undesirable mixture of the contents of the two adjacent pixels takes place. A similar effect can be obtained in the case where a plurality of projections and pits are formed in one pixel.

Although high speed line access could be realized by employing the aforesaid driving method, the average transmittance light quantity of the black pixel on the information line which substantially writes white and the average transmittance light quantity of the black pixel on the information line which completely writes black become different from each other.

It is due to the difference in the fluctuation of molecules of the black pixel depending upon the information signal for use at the time of writing liens except for the subject black pixel.

The following methods have been found to prevent the aforesaid fluctuation phenomenon.

(1) The difference in the average transmittance light quantity among all of the information signals is eliminated (or decreased). It can be realized by an original information signal and a signal portion for correcting the difference in the light quantity (refer to Japanese Patent Application Laid-Open No. 3-73127).

(2) In order to realize the effect (1) while maintaining the speed realized in Example 1, information signal waveforms are set for the gradations (see FIG. 6).

Figure 7:
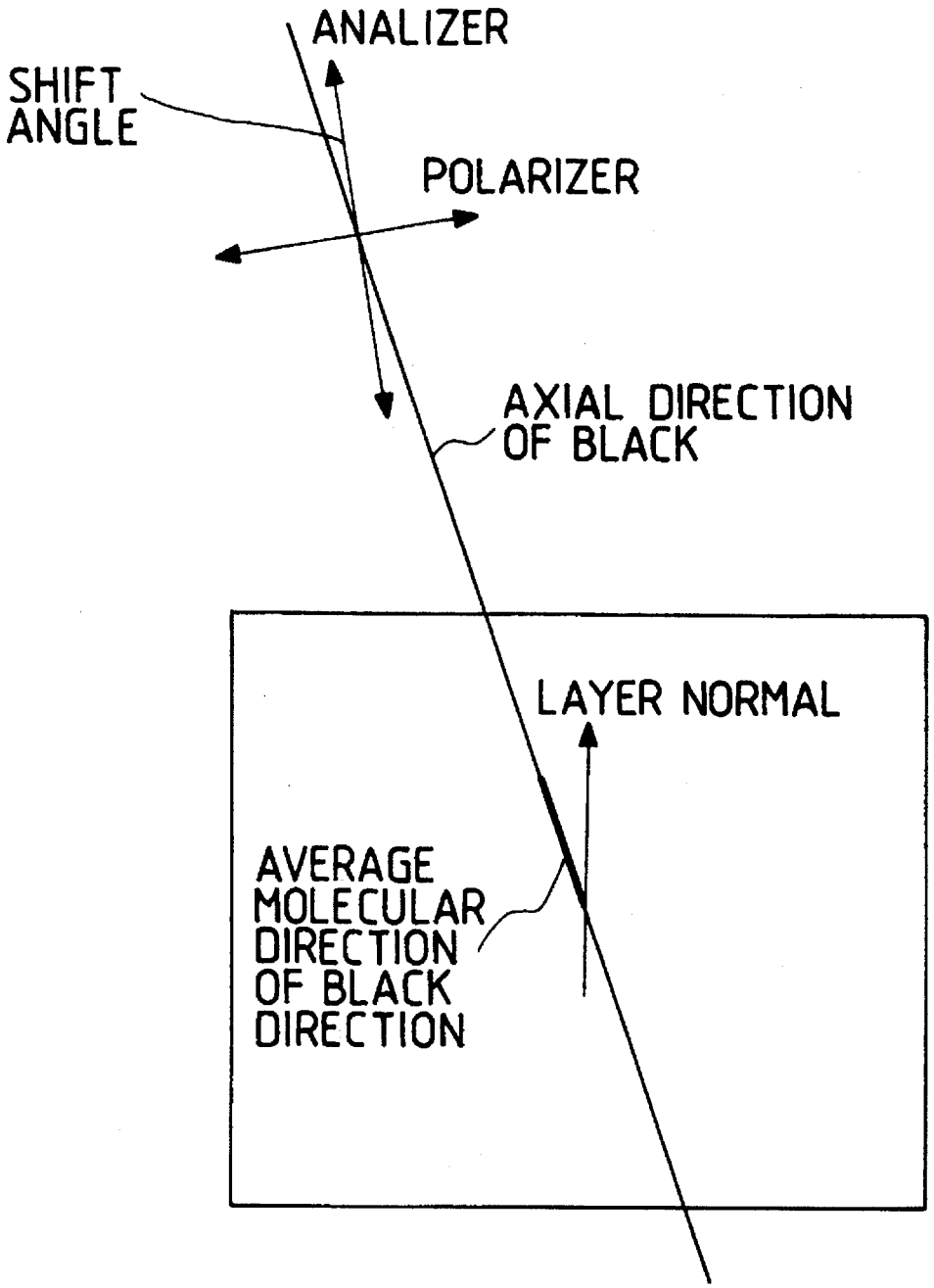
FIG. 7 illustrates the angle of a polarizer of a liquid crystal display device according to the present invention.
Figure 8:
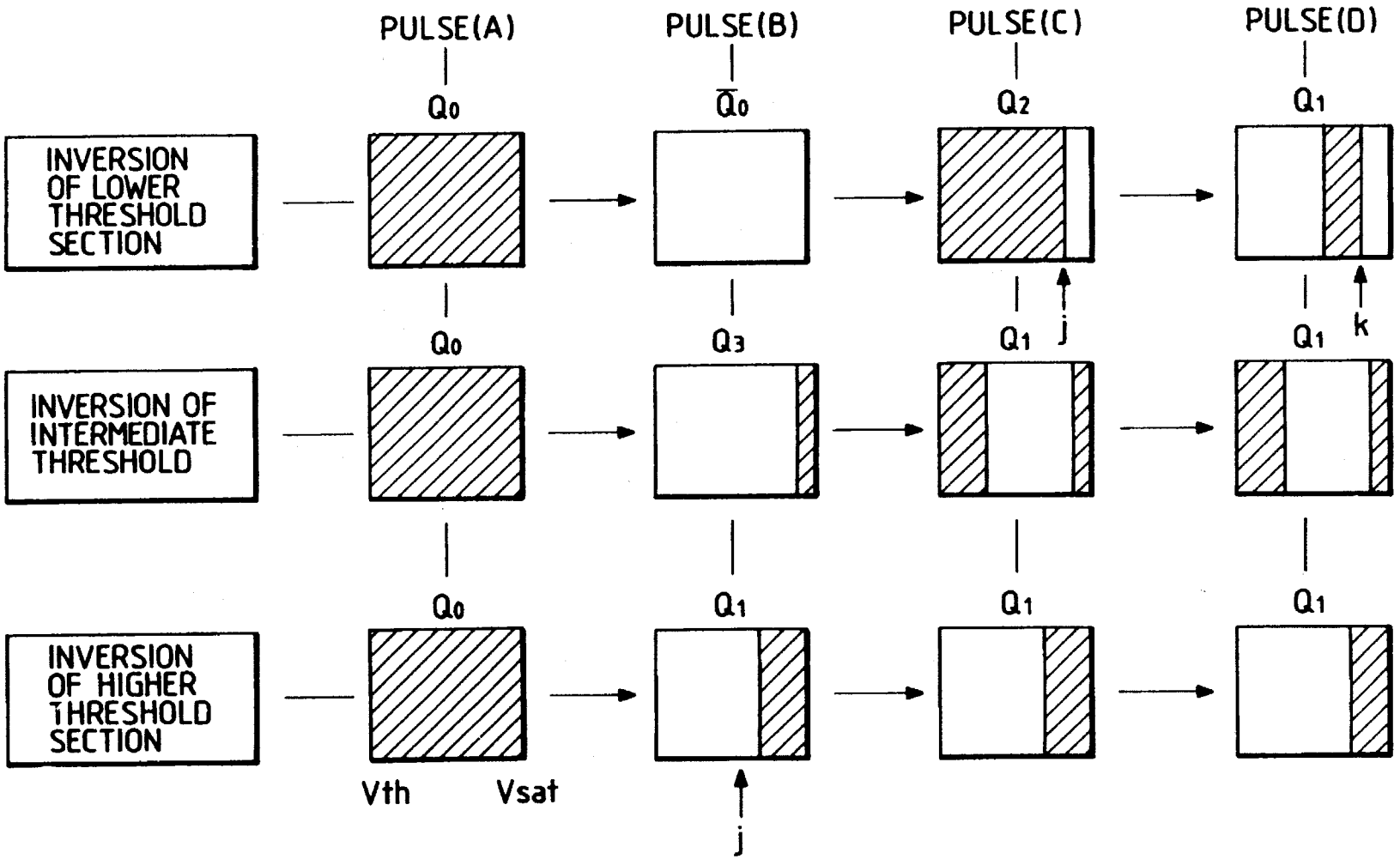
FIG. 8 (PRIOR ART)
FIG. 8 illustrates a conventional gradation driving method.
Figure 11:
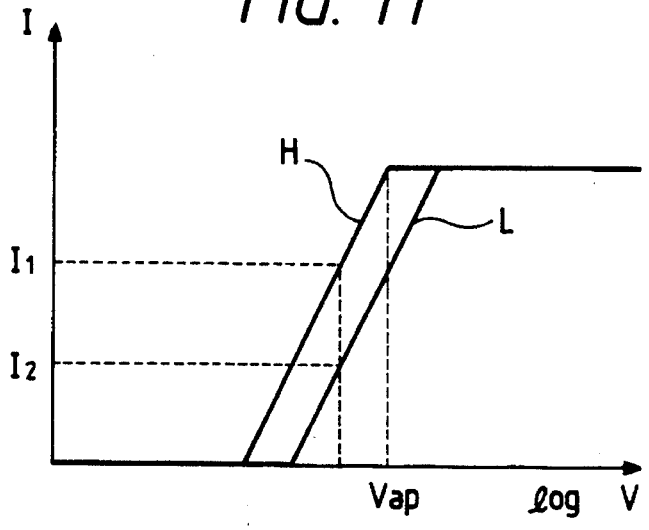
FIG. 11 illustrates the conventional gradation driving method.

(3) The position of the polarizer is shifted slightly from the darkest state, so that the light quantity difference is decreased (see FIG. 7).

(4) The voltage level is fixed as is fixed in Example 3 and the gradation information is controlled with the pulse width.

Figure 6A:
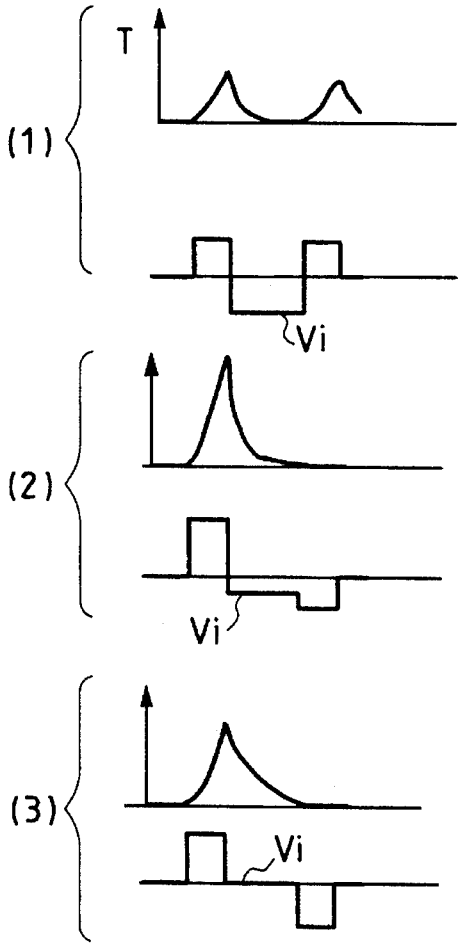
FIGS. 6A and 6B illustrate the principle of a gradation expression and correction according to the present invention.
Figure 6B:
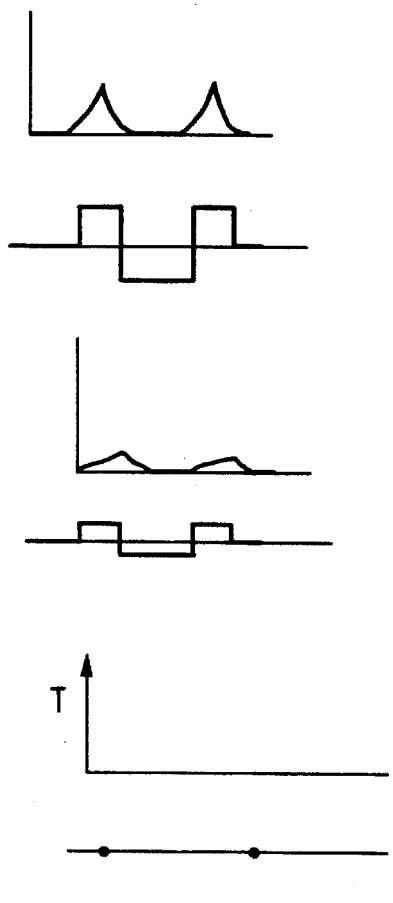

The method (2) will be described with reference to FIGS. 6A and 6B. FIG. 6B illustrates an information signal which does not correct the average transmittance light quantity, while FIG. 6A illustrates the information signal which has been corrected. By employing the waveforms (1), (2) and (3) and by changing the previous and post voltage levels while maintaining the gradation information voltage Vi (however, the average voltage level is made to be the central value), the difference in the average transmittance light quantity between gradation information can be significantly decreased as can be understood from a sketch of the transmissive light quantity drawn on the information signal waveforms (1), (2) and (3) in which a comparison between FIGS. 6A and 6B is made.

In this embodiment, the fluctuation of the image can be somewhat improved by employing the method (3) and by shifting the black state by 2° from the darkest state.

The shifting direction was made in the normal direction of the layer.

Figure 4:
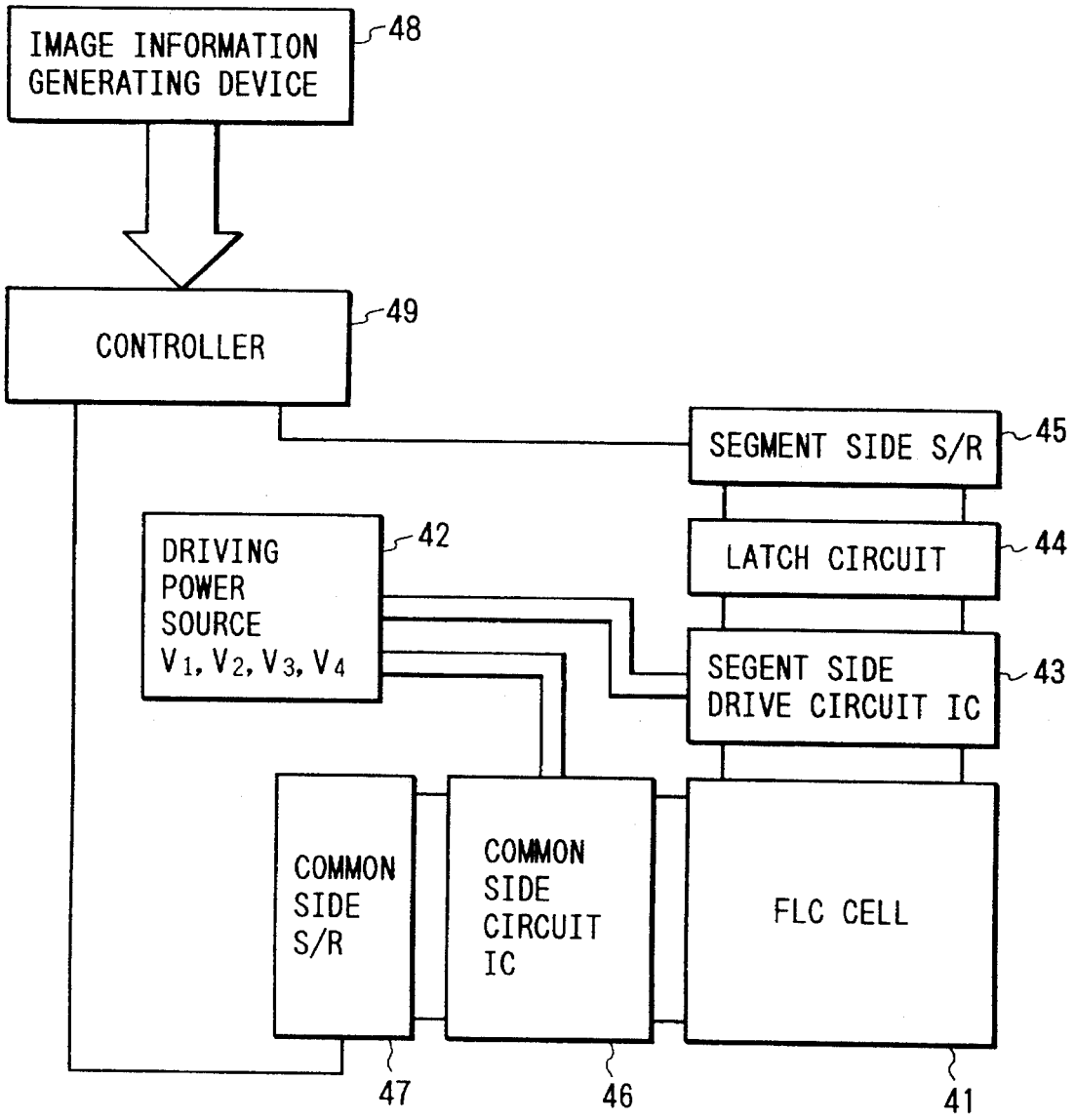
FIG. 4 is a block diagram which illustrates a driving circuit according to the present invention.

FIG. 4 is a block diagram which illustrates a structure for supplying the signal shown in FIG. 1 to the liquid crystal cell. Referring to FIG. 4, reference numeral 41 represents a liquid crystal cell, 42 represents a driving power source capable of outputting voltages of a various levels, 43 represents a segment driving IC, 44 represents a latch circuit, 45 represents a segment shift register, 46 represents a common (scanning portion) driving IC, 47 represents a common portion shift register, 48 represents an image information generating device, and 49 represents a controller.

In the structure shown in FIG. 4, the gradation signal (voltage of a variety of levels) is supplied in such a manner that a DA converter is disposed in the segment driving IC 43, and a digital gradation signal ($2^4$=16 gradations if a 4-bit signal for example) supplied through the latch circuit 44 is converted into an analog signal (16 types of information signals) so as to be applied to segment lines (information signal lines $I_1$ to $I_m$), In this case, a scanning signal for the common side (scanning side) driving IC 46 was formed by distributing the driving power source 42 by using an analog switch. As for the means for supplying the analog signal to the segment line, a method may be employed a capacity is provided for the driving IC portion in parallel and the analog signal is directly input and held.

(Example 2)

Figure 2:
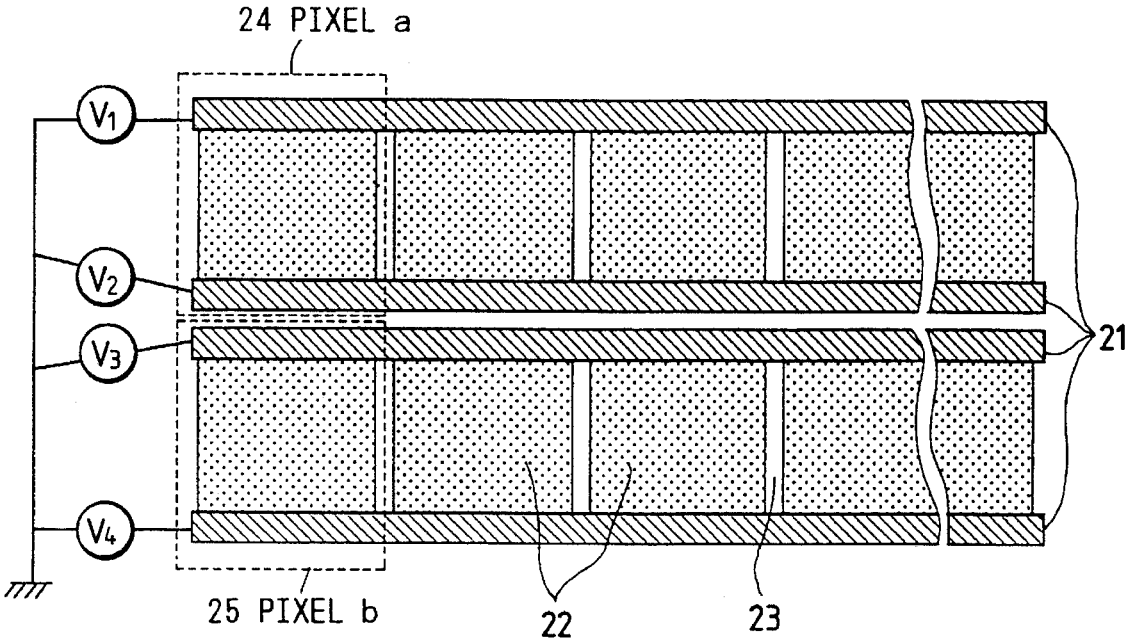
FIG. 2 illustrates the structure of an electrode according to Example 2.

A cell having electrodes as shown in FIG. 2 was used as Example 2.

Referring to FIG. 2, reference numeral 21 represents a metal circuit, 22 represents a large-resistance conductive film, and 23 represents a portion having no large-resistance film.

An $SnO_2$ film was used as the large-resistance film 22, the $SnO_2$ film being formed on a glass substrate by sputtering to have a sheet resistance of about $10^7\Omega/cm^2$.

The $SnO_2$ film 23 was formed in such a manner that metal mask was formed on the substrate and a lift-off processes was then performed.

The metal circuit 21 was formed in such a manner that Cr was patterned on the $SnO_2$ film and Al was formed on it to have a thickness of about 5000 Å.

Symbols V1 to V4 represent constant-voltage power sources for determining the potential of the metal circuit 21.

In FIG. 2, two portions each surrounded by a dashed line are two pixels composed of a pixel a represented by reference numeral 24 and a pixel b represented by reference numeral 25.

A pixel is made of $SnO_2$ interposed between two metal circuits 21.

A method of displaying image gradation by distributing an electric field in the pixel by the electrode structure as described above is called a "potential gradient method" hereinafter.

The potential gradient method is a method in which the potentials of the two metal circuits which interpose a pixel are made to be different from each other (an electric current is allowed to pass through a pixel by, for example, making $V_1>V_2$ shown in the drawing) so as to form a continuous gradient of the potential in an electrode substrate from an electrode terminal having a potential of $V_1$ to an electrode terminal having a potential of $V_2$. The aforesaid substrate is used as a scanning signal substrate and an opposing electrode substrate serving as an information signal substrate is an ordinary ITO electrode substrate of a type used in Example 1.

The orientation process and the liquid crystal were the same as those used in Example 1. If the continuous potential distribution is present in the pixel on either of the electrode substrates, the potential difference is distributed in the pixel although the potential of the opposite electrode is constant. Therefore, the intensity of the electric field to be applied to the liquid crystal can be directly controlled by the gradient of the potential by using a cell having an equal thickness in the pixel.

Figure 3:
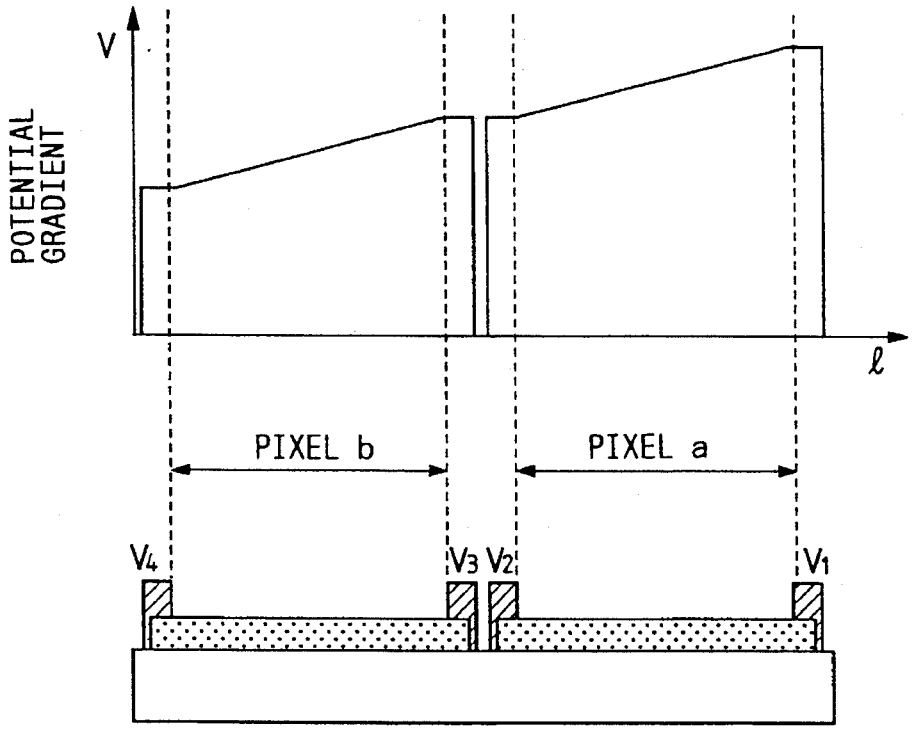
FIG. 3 illustrates the potential gradient realized in Example 2.

FIG. 3 is a graph which illustrates the relationship between the potential gradient and the pixels a and b shown in FIG. 2.

As shown in FIG. 3, the potential change in the pixels a and b can be made to be continuous by satisfying the following conditions:

$$V_3/V_4=V_1/V_2 \text{ and } V_2=V_3.$$

The intensity of the electric field to be actually applied to the liquid crystal layer is determined by the potential cell thickness of the opposite substrate and the information voltage $V_i$.

If the thickness of the cell is made constant in the pixel, the electric field to be applied to the liquid crystal layer is changed in the pixel at a similar gradient to the change of the potential shown in FIG. 3, and the portion of the FLC exceeding the switching threshold is changed in accordance with the level of $V_i$. In inverse proportion to the temperature, the switching threshold of the FLC is lowered and therefore the switching area is changed (the thresholds of the two pixels are continuously changed with respect to $V_i$). All of the methods described in the "Detailed Description of the Invention" are applicable except for the method in which the distribution of the electric field is realized in the pixel.

When $V_i$ is gradually changed in the cell thus structured, the $V_1$ supply side of the pixel a is first switched, and then the $V_2$ supply side is switched. By further changing it in a direction in which the intensity of the electric field is raised, the $V_3$ supply side of the pixel b is switched. Finally, the $V_4$ side of the pixel b is switched. That is, the pixel a and the pixel b are continued to each other in terms of the threshold.

The voltage conditions at the time of the selection in this example are as follows:

$V_1$=10.5 volt $V_2$=7.5 volt $V_3$=7.5 volt $V_4$=5.4 volt $V_i$=1.0 to 6.1 volt The thickness of the cell is about 1.0 μm.

By employing the aforesaid method, the driving speed was significantly raised in comparison to the driving speed realized by the conventional "4-pulse method".

The image gradation display method by utilizing the potential gradient exhibits a different advantage from that obtainable from the cell thickness change method according to Example 1 because the cell thickness change can be compensated in terms of the operation similarly to the compensation of the temperature change.

(Example 3)

A liquid crystal cell having a cross sectional shape as shown in FIG. 5 was manufactured as Example 3. The sawtooth shape of the lower substrate shown in FIG. 5 was manufactured in such a manner that a pattern was formed on a mold and it was transferred to the upper surface of the glass substrate by using an acrylic UV setting resin 52. On the sawtooth shape made of the UV setting resin 52, an ITO film was formed as a stripe electrode 51 by sputtering. Then, oriented film LQ-1802 manufactured by Hitachi Kasei was formed on the stripe electrode 51 so as to serve as a directed film 54 to have a thickness of about 300 Å. The cell substrate place to oppose it was formed by an oriented film on the stripe electrode 51, the cell substrate having no projections and pits.

The upper and the lower substrates were rubbed in parallel and the cell was constituted in such a manner that the direction, in which the lower substrate was rubbed, was deflected by about 6° in the right-handed screw direction from the direction in which the upper substrate was rubbed. The cell thickness was controlled so as to make the thin portion to have a thickness of about 1.0 μm and to make the thick portion to have a thickness of about 1.4 μm. Furthermore, the stripe electrode 51 of the lower substrate was patterned into a stripe shape along the rib so that one side of the sawtooth was made to be one pixel.

The width of the stripe electrode 51 was made to be 300μm and the pixel was formed into a rectangular having a size 300 μm×200 μm.

Used materials of the liquid crystal are shown Table 2.

TABLE 2

Liquid Crystal A

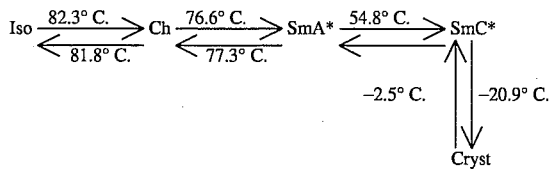

| | |
|---|---|
| Ps = 5.8 nC/cm², Ps < 0 | 30° C. |
| Tilting angle = 14.3° | 30° C. |
| Δε ~ −0 | 30° C. |

The threshold of the liquid crystal was 11.5 volt/μm (80 μS pulse at 25° C.), and the threshold of each pixel was 11.5 to 16.1 volt (80 μS pulse at 25° C.).

Figure 19:
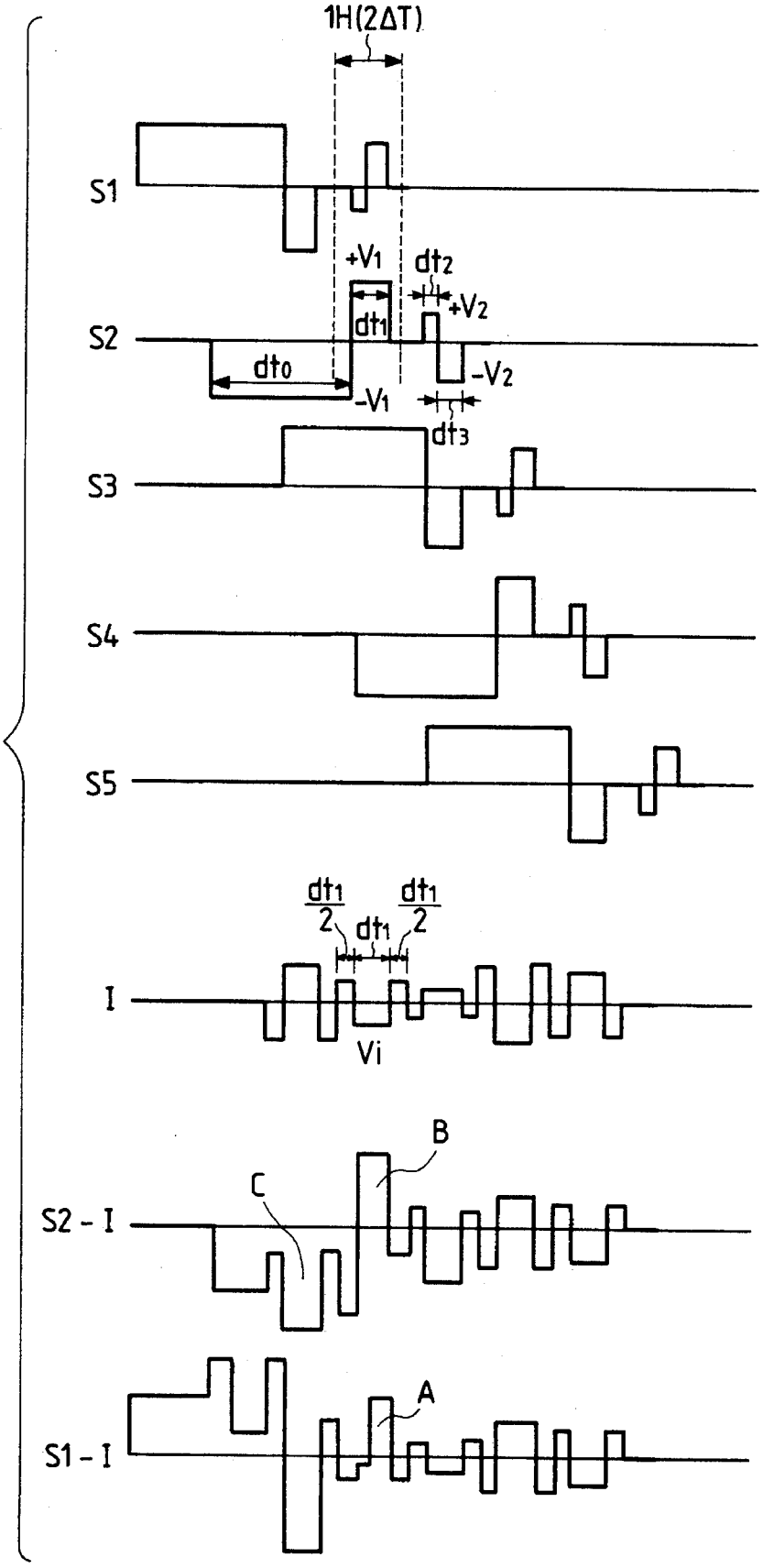
FIG. 19 illustrates the driving waveforms according to Example 3.

FIG. 19 illustrates driving waveforms.

Referring to FIG. 19, symbols S1 to S5 represent scanning signal waveforms and I represents an information signal waveform.

The distribution of the temperature of the liquid crystal pulse was restricted to a range from 25°–30° C.

A ΔT (pulse width)–V (voltage) curve at this time is shown in FIG. 20 (the characteristics realized in a 1 μm cell).

The pulse width and the voltage level of each pulse shown in FIG. 1 were set as follows:

$dt_0$=240 μs $dt_1$=80 μs $dt_2$=49.5 μs $dt_3$=30.5 μs $V_1$=10.0 volt $V_2$=10.0 volt $V_3$=8.0 volt $V_4$=10.0 volt The information signal $V_{op}$ (the scanning voltage+the information voltage) is determined by the following equation in the case of X %:

$$Vi = -10\left(\frac{X}{100}\cdot\log\frac{16.1}{11.5}\right)\cdot 11.5$$

. . . in the case where black deletion line $$Vi = 10\left(\frac{(100-X)}{100}\cdot\log\frac{16.1}{11.5}\right)\cdot 11.5$$

. . . in the case where white deletion line

Referring to FIG. 19, an electric signal to be supplied to the line S2 was represented by S2-I.

Among the pulse group, waveform C indicates the deletion of the pixel (collectively written to be white or black), while ensuing waveform B indicates writing on the line S2.

An electric signal to be supplied to the line S1 is represented by S1-I, and symbol A represents information to be written on the line $S_1$ so as to compensate the temperature of the line S2.

Gradation display by the thus constituted cell and by the arranged driving waveforms, the quality of the gradation display could be improved (the temperature range could be restricted) regardless of the irregular temperature distribution (the temperature was distributed in a range from 25°–30° C.) in the liquid crystal panel.

With the aforesaid method, the time required to drive one frame can be shortened to one-third in comparison to the conventional 4-pulse method. Since one pixel must be subjected to writing three times after the deletion in the 4-pulse method, three times the time required in the present invention was taken.

When the deletion direction by the scanning line is made opposite in the frame, the stability of the domain wall can be improved. It can be considered that the generation of the deviation of ions in the FLC layer is prevented sufficiently.

Although high speed line access could be realized by employing the aforesaid driving method, the average transmittance light quantity of the black pixel on the information line which substantially writes white and the average transmittance light quantity of the black pixel on the information line which completely writes black become different from each other.

It is due to the difference in the fluctuation of molecules of the black pixel depending upon the information signal for use at the time of writing lines except for the subject black pixel.

The following methods have been found to prevent the aforesaid fluctuation phenomenon.

(1) The difference in the average transmittance light quantity among all of the information signals is eliminated (or decreased). It can be realized by an original information signal and a signal portion for correcting the difference in the light quantity (refer to Japanese Patent Application No. 3-73127).

(2) In order to realize the effect (1) while maintaining the speed realized in Example 1, information signal waveforms are set for the gradations (see FIG. 6).

(3) The position of the polarizer is shifted slightly from the darkest state, so that the light quantity difference is decreased (see FIG. 7).

(4) The voltage level is fixed as is fixed in Example 3 and the gradation information is controlled with the pulse width.

The method (2) will be described with reference to FIGS. 6A and 6B. FIG. 6B illustrates an information signal which does not correct the average transmittance light quantity, while FIG. 6A illustrates the information signal which has been corrected. By employing the waveforms (1), (2) and (3) and by changing the previous and post voltage levels while maintaining the gradation information voltage Vi (however, the average voltage level is made to be the central value), the difference in the average transmittance light quantity between gradation information can be significantly decreased as can be understood from a sketch of the transmissive light quantity drawn on the information signal waveforms (1), (2) and (3) in which a comparison between (a) and (b) is made.

In this embodiment, the fluctuation of the image can be somewhat improved by employing the method (3) and by shifting the black state by 2° from the darkest state.

The shifting direction was made in the normal direction of the layer.

FIG. 4 is a block diagram which illustrates a structure for supplying the signal shown in FIG. 19 to the liquid crystal cell. Referring to FIG. 4, reference numeral 41 represents a liquid crystal cell, 42 represents a driving power source capable of outputting voltages of a various levels, 43 represents a segment driving IC, 44 represents a latch circuit, 45 represents a segment shift register, 46 represents a common (scanning portion) driving IC, 47 represents a common portion shift register, 48 represents an image information generating device, and 49 represents a controller.

In the structure shown in FIG. 4, the gradation signal (voltage of a variety of levels) is supplied in such a manner that a DA converter is disposed in the segment driving IC 43, and a digital gradation signal ($2^4$=16 gradations if a 4-bit signal for example) supplied through the latch circuit 44 is converted into an analog signal (16 types of information signals) so as to be applied to segment lines (information signal lines $I_1$ to $I_m$). In this case, a scanning signal for the common side (scanning side) driving IC 46 was formed by distributing the driving power source 42 by using an analog switch. As for the means for supplying the analog signal to the segment line, a method may be employed a capacity is provided for the driving IC portion in parallel and the analog signal is directly input and held.

(Example 4)

Since Example 3 is arranged in such a manner that the line S1 is selected and then the line S2 is selected as shown in FIG. 19, the threshold sometimes becomes unstable depending upon the state of the orientation of the liquid crystal (the change of the threshold due to continuous writing).

Figure 21:
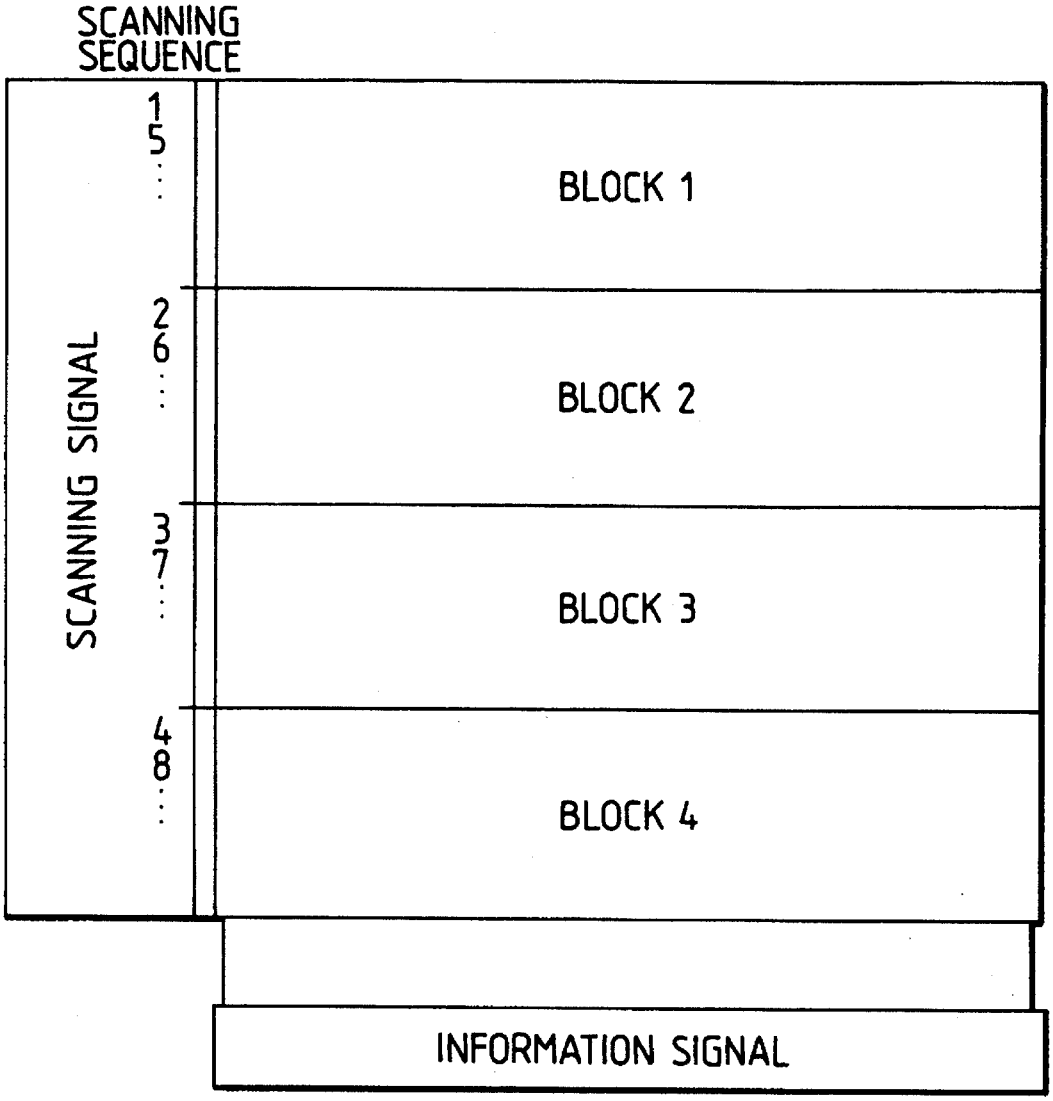
FIG. 21 illustrates a scanning method according to Example 4.

In order to prevent this, 1000 scanning lines is divided into four blocks each having 250 scanning lines as shown in FIG. 21 so that the blocks are sequentially scanned. As a result, writing is not continuously performed on one substrate, and therefore the accuracy in displaying the image gradation can be improved.

Use of the aforesaid method will enable an effect to be obtained in that the fluctuation of the frame taken place in the case where the frame speed is slow can be prevented, and therefore the quality of the displayed image can be improved.

If the frame speed is further slow (5 to 8 Hz), random access may be performed in each block in order to maintain the quality of the image.

The last terminal of the previous block is used as the temperature compensating terminal S1 in the leading portion of each block, so that the continuity of the display image is maintained.

(Example 5)

A liquid crystal cell having a cross sectional shape as shown in FIG. 5 was manufactured as Example 1. The sawtooth shape of the lower substrate shown in FIG. 5 was manufactured in such a manner that a pattern was formed on a mold and it was transferred to the upper surface of the glass substrate by using an acrylic UV setting resin 52. On the sawtooth shape made of the UV setting resin 52, an ITO film was formed as a stripe electrode 51 by sputtering. Then, oriented film LQ-1802 manufactured by Hitachi Kasei was formed on the stripe electrode 51 so as to serve as a directed film 54 to have a thickness of about 300 Å. The cell substrate place to oppose it was formed by an oriented film on the stripe electrode 51, the cell substrate having no projections and pits.

The upper and the lower substrates were rubbed in parallel and the cell was constituted in such a manner that the direction, in which the lower substrate was rubbed, was deflected by about 6° in the right-handed screw direction from the direction in which the upper substrate was rubbed. The cell thickness was controlled so as to make the thin portion to have a thickness of about 1.0 μm and to make the thick portion to have a thickness of about 1.4 μm. Furthermore, the stripe electrode 51 of the lower substrate was patterned into a stripe shape along the rib so that one side of the sawtooth was made to be one pixel.

The width of the stripe electrode 51 was made to be 300 μm and the pixel was formed into a rectangular having a size 300 μm×200 μm.

Figures 23A, 23B:
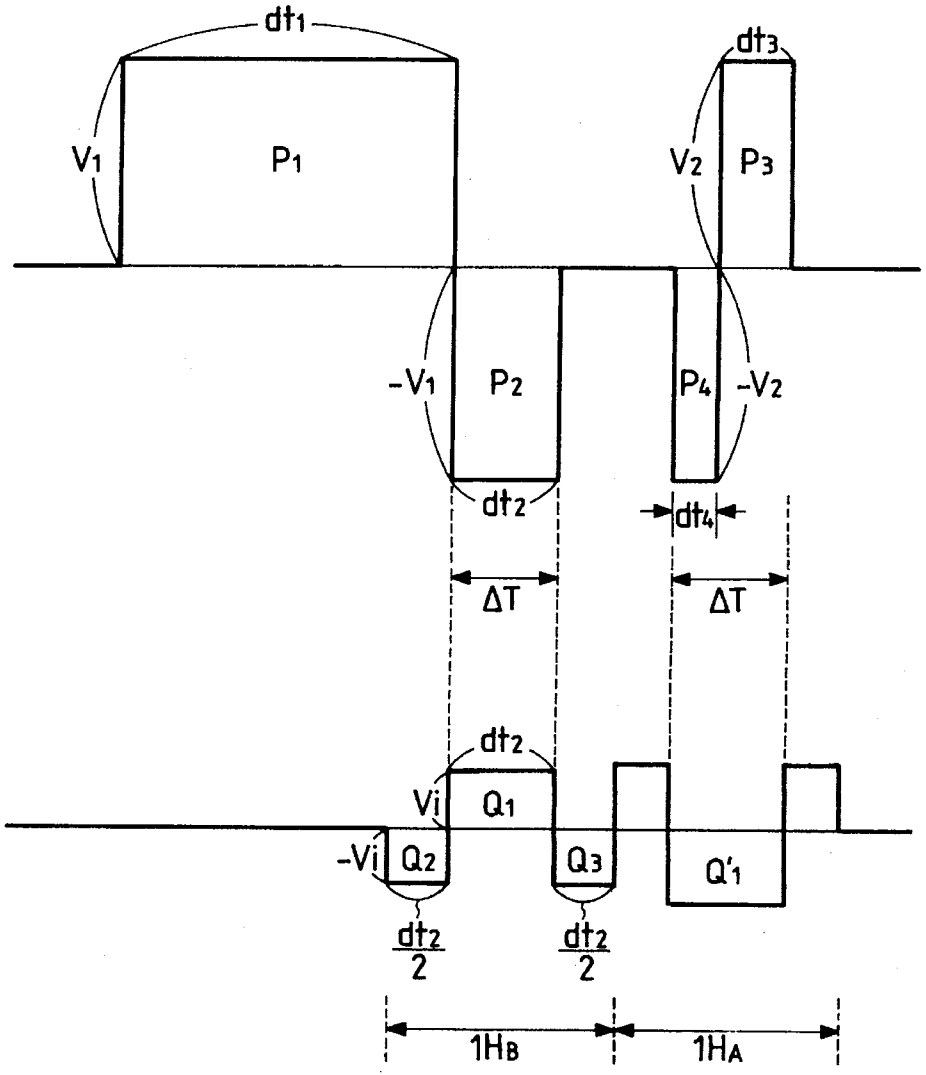
FIGS. 23A and 23B illustrate the driving waveforms according to Example 5.

FIGS. 23A and 23B illustrates the driving waveforms, where FIG. 23A is a scanning signal waveform composed of a reset pulse $P_1$, a selection pulse $P_2$ for writing the subject line, a selection pulse $P_3$ for compensating the adjacent line threshold change, and a sub-pulse $P_4$.

FIG. 23B illustrates an information signal waveform composed of a selection pulse $Q_1$ and sub-pulses $Q_2$ and $Q_3$ for setting off the DC component of the selection pulses $Q_1$. Symbol $1H_B$ represents a period in which an information signal waveform is supplied to the scanning signal waveform (a) and $1H_A$ represents a period in which the information signal waveform of the adjacent line is applied to the same.

Figure 22:
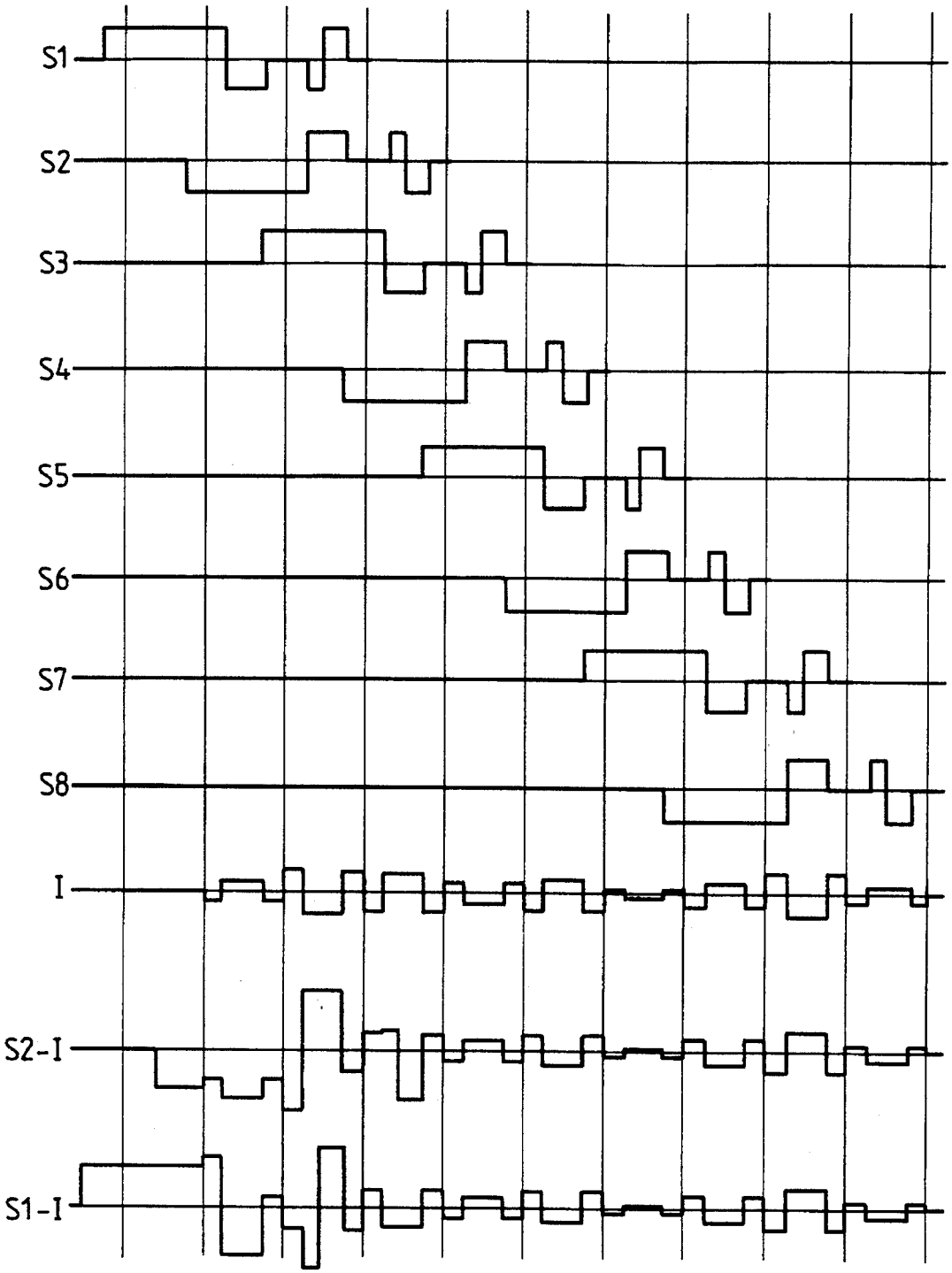
FIG. 22 is a time sequential view which illustrates a driving waveforms according to Example 5.

Symbol ΔT represents a period in which the selection pulses $P_2$ and $Q_1$ are synchronized with each other and a period in which the selection pulses $P_3$ and $Q'_1$ are synchronized with each other FIG. 22 illustrates a time sequence of the driving waveform.

Referring to FIG. 22, symbols $S_1$ to $S_8$ represent scanning signal waveforms, and I represents an information signal waveform. A ΔT (pulse width)–V (voltage) curve when the temperature distribution of the liquid crystal panel is restricted to a range from 25°–30° C. is shown in FIG. 20 (characteristics of a 1 μm cell).

The width and the voltage level of each pulse shown in FIGS. 23A and 23B are determined as follows:

$dt_1$=240 μs $dt_2$=80 μs $dt_3$=49.5 μs $dt_4$=30.5 μs $V_1$=10.0 volt $V_2$=10.0 volt The information signal Vi is determined by the following equation in the case where the image gradation by X % is performed:

When white is selected;

$$Vi = 10 - 11.5 \times 10^{\left(\frac{x}{100} \cdot \log \frac{16.1}{11.5}\right)}$$

volt ($-6.1 \leqq Vi \leqq -1.5$)

When black is selected;

$$Vi = 11.5 \times 10^{\left(\frac{100-x}{100} \cdot \log \frac{16.1}{11.5}\right)}$$

-continued volt ($1.5 \leqq Vi \leqq 6.1$)

If depends upon a result of a process in which a portion of a pixel is written when a pulse having a width of 80 μs and a voltage of 11.5 V when the temperature of the pixels is 25° C. and then the overall portion of the pixel is written after the voltage has been raised to 16.1 V.

Referring to FIG. 22, an electric signal to be applied to the line S2 is represented by S2-I.

Among the pulse group, waveform C indicates the deletion of the pixel (collectively written to be white or black), while ensuring waveform B indicates writing on the line $S_2$.

An electric signal to be supplied to the line $S_1$ is represented by $S_1$-I, and symbol A represents information to be written on the line $S_1$ so as to compensate the temperature of the line $S_2$.

Gradation display by the thus constituted cell and by the arranged driving waveforms, the quality of the gradation display could be improved (the temperature range could be restricted) regardless of the irregular temperature distribution (the temperature was distributed in a range from 25°–30° C.) in the liquid crystal panel.

With the aforesaid method, the time required to drive on frame can be shortened to one-third in comparison to the conventional 4-pulse method. Since one pixel must be subjected to writing three times after the deletion in the 4-pulse method, three times the time required in the present invention was taken.

When the deletion direction by the scanning line is made opposite in the frame, the stability of the domain wall can be improved. It can be considered that the generation of the deviation of ions in the FLC layer is prevented sufficiently.

Figure 24:
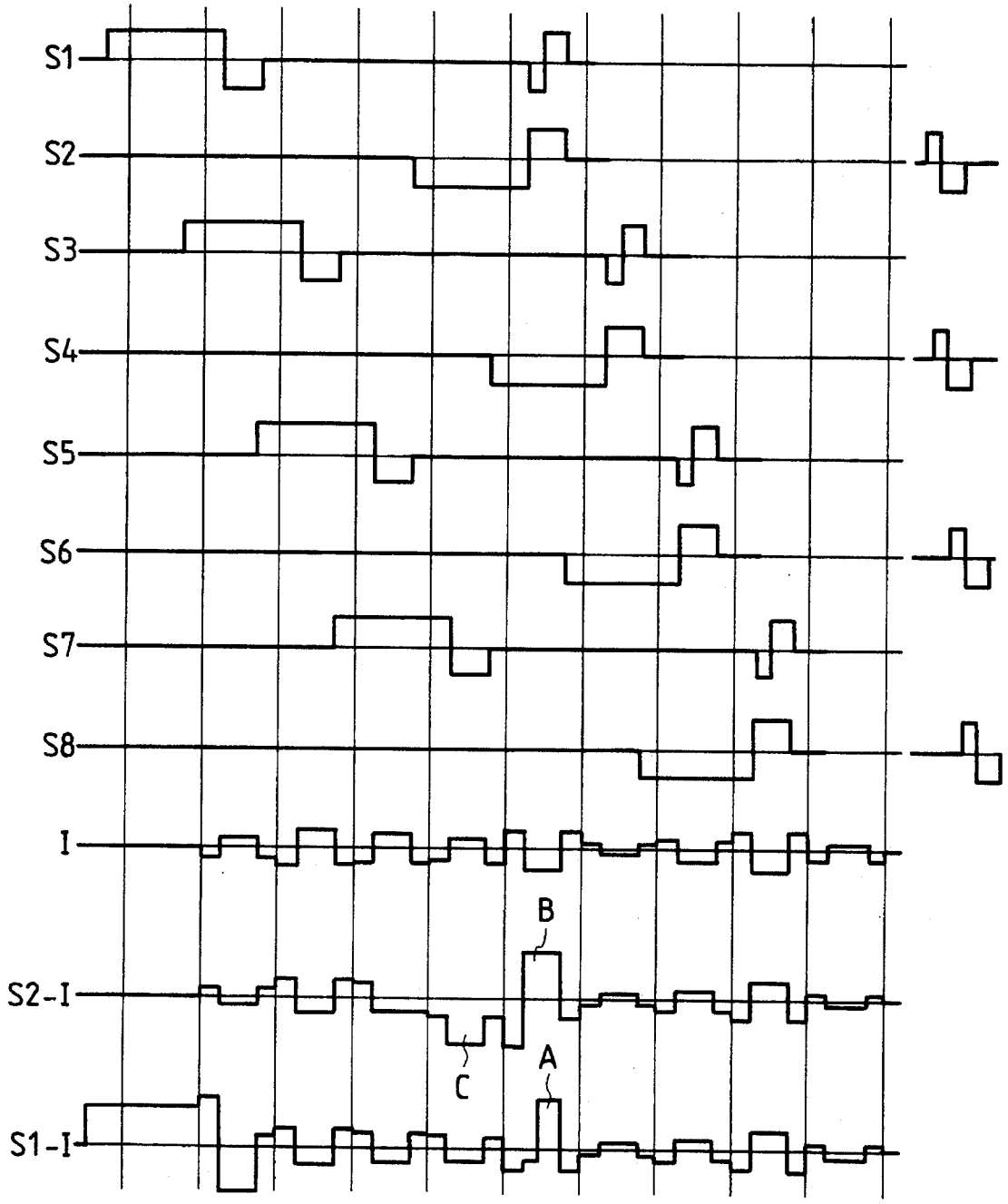
FIG. 24 is another time sequential view which illustrates driving waveform according to Example 5.

The liquid crystal panel may be driven by another scanning method except or the line sequential scanning method. FIG. 24 illustrates the time sequence when an inter-less scanning.

Figure 25:
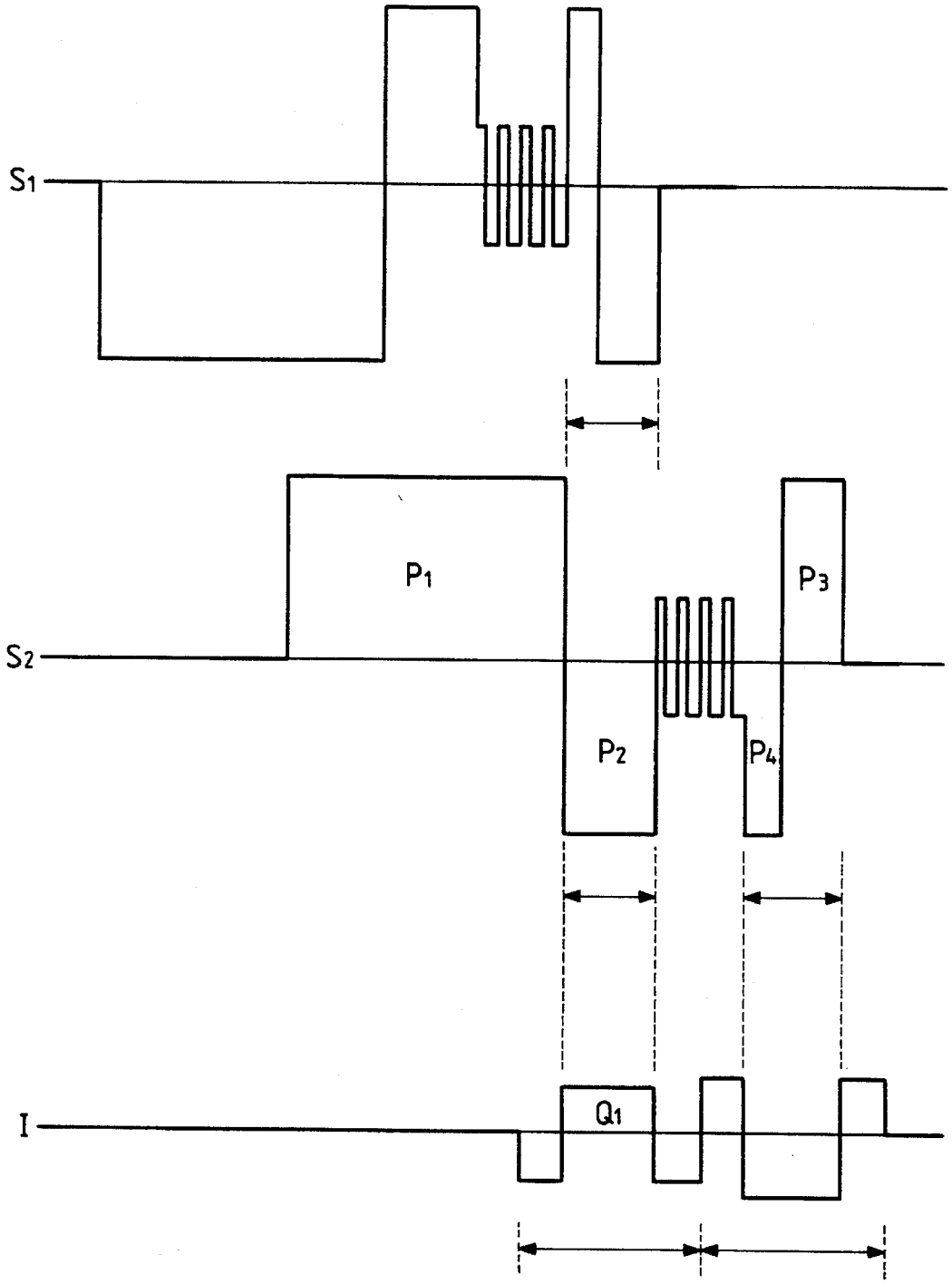
FIG. 25 illustrates other driving waveforms according to Example 5.

Another waveform for use in the example is shown in FIG. 25. In this example, an AC waveform is interposed between the two selection pulses $P_2$ and $P_3$ so as to prevent an influence of the pulse $P_2$ upon the pulse $P_3$.

Even if the liquid crystal material, the thickness of the cell, the orienting conditions, and the ambient temperature and the like are changed, the image gradation can be satisfactorily displayed by adequately setting the parameters of the waveforms shown in FIGS. 22 and 24.

Figure 33:
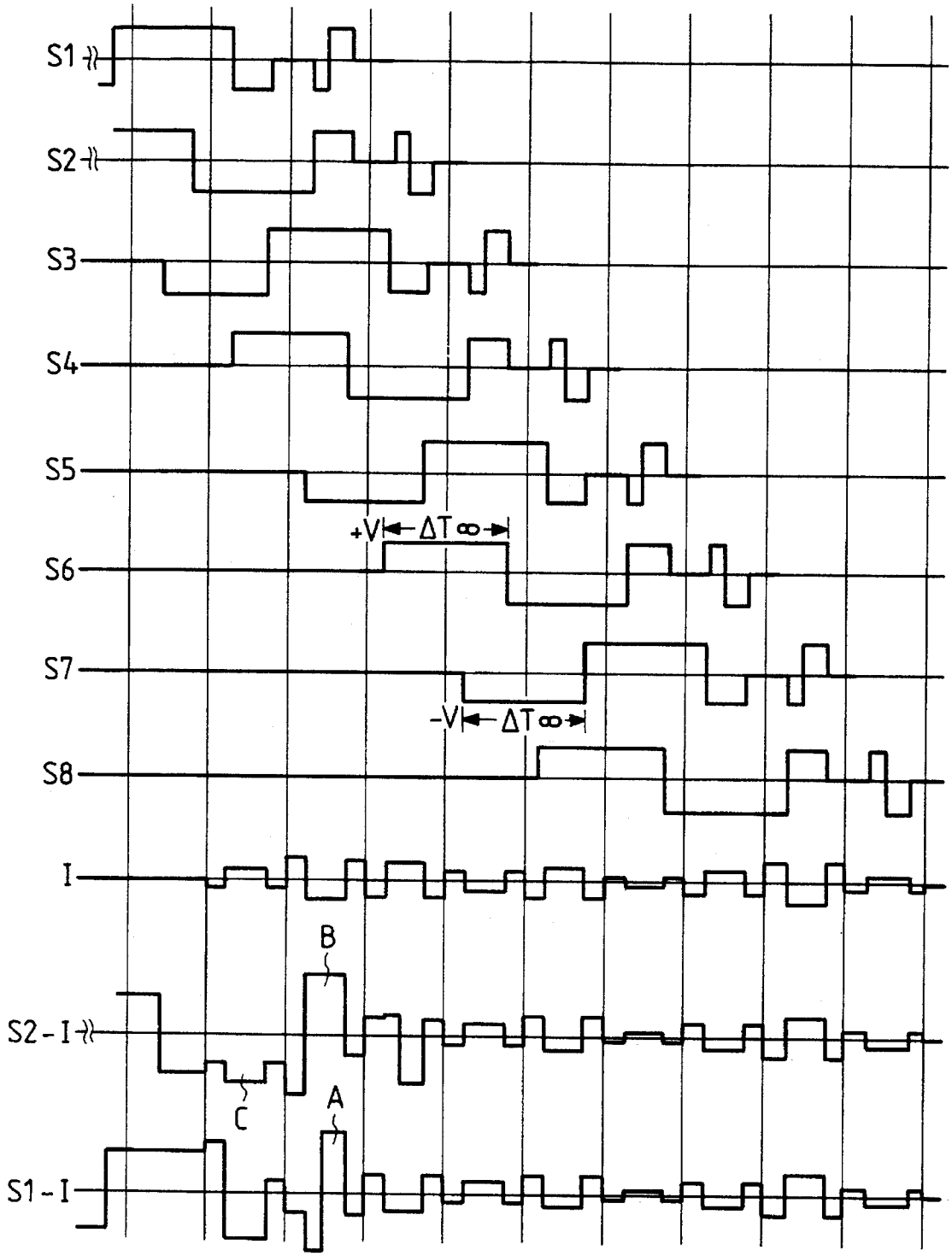
FIG. 33 is a time sequential view which illustrates other driving waveforms according to Example 5.

In the case where the line sequential scanning operation is performed, the quality of the display deteriorates due to excessive flicker if scanning signal the deleting directions of which are different from each other. In order to prevent this, the deletion pulses for the scanning signals are composed of a bipolar pulses. An example of this is shown in FIG. 33.

It can be considered that the fluctuation is reduced by decreasing the difference in the light quantity change at the time of the scanning (selection) process between the scanning lines the deleting directions of which are different from each other.

(Example 6)

A liquid crystal cell having a cross sectional shape as shown in FIG. 5 was manufactured as Example 6. The sawtooth shape of the lower substrate shown in FIG. 5 was manufactured in such a manner that a pattern was formed on a mold and it was transferred to the upper surface of the glass substrate by using an acrylic UV setting resin 52. On the sawtooth shape made of the UV setting resin 52, an ITO film was formed as a stripe electrode 51 by sputtering. Then, oriented film LQ-1802 manufactured by Hitachi Kasei was formed on the stripe electrode 51 so as to serve as a directed film 54 to have a thickness of about 300 Å. The cell substrate place to oppose it was formed by an oriented film on the stripe electrode 51, the cell substrate having no projections and pits.

The upper and the lower substrates were rubbed in parallel and the cell was constituted in such a manner that the direction, in which the lower substrate was rubbed, was deflected by about 6° in the right-handed screw direction from the direction in which the upper substrate was rubbed. The cell thickness was controlled so as to make the thin portion to have a thickness of about 1.0 μm and to make the thick portion to have a thickness of about 1.4 μm. Furthermore, the stripe electrode 51 of the lower substrate was patterned into a stripe shape along the rib so that one side of the sawtooth was made to be one pixel.

The width of the stripe electrode 51 was made to be 300 μm and the pixel was formed into a rectangular having a size 300 μm×200 μm.

Figures 28A, 28B:
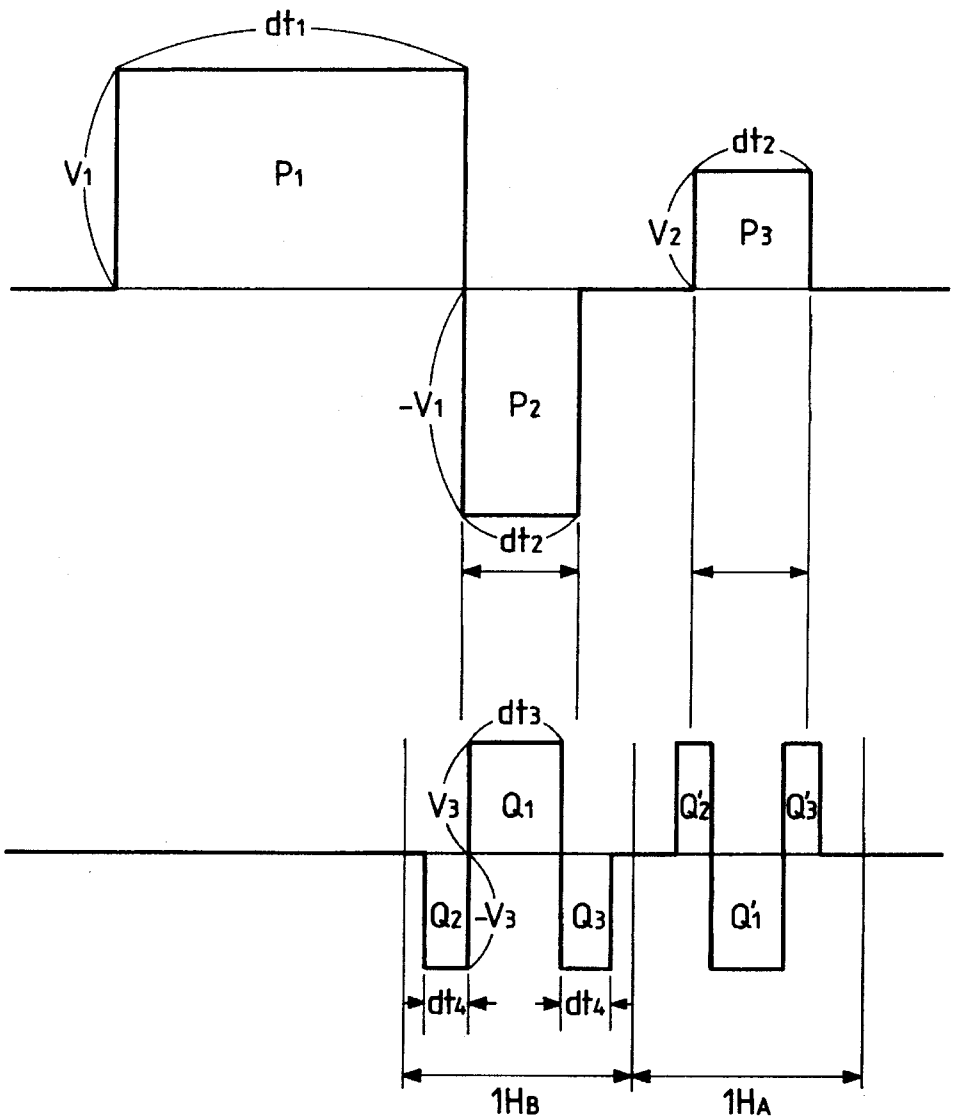
FIGS. 28A and 28B illustrate the driving waveforms according to Example 6.

FIGS. 28A and 28B illustrate the driving waveforms FIG. 28A is a scanning signal waveform composed of a reset pulse $P_1$, a selection pulse $P_2$ for writing the subject line, and a selection pulse $P_3$ for compensating the adjacent line threshold change. While FIG. 28B illustrates an information signal waveform composed of a selection pulse $Q_1$ and sub-pulses $Q_2$ and $Q_3$ for setting off the DC component of the selection pulses $Q_1$.

Symbol $\mathbf{1}H_B$ represents a period in which an information signal waveform is supplied to the scanning signal waveform (a) and $\mathbf{1}H_A$ represents a period in which the information signal waveform of the adjacent line is applied to the same.

Figure 27:
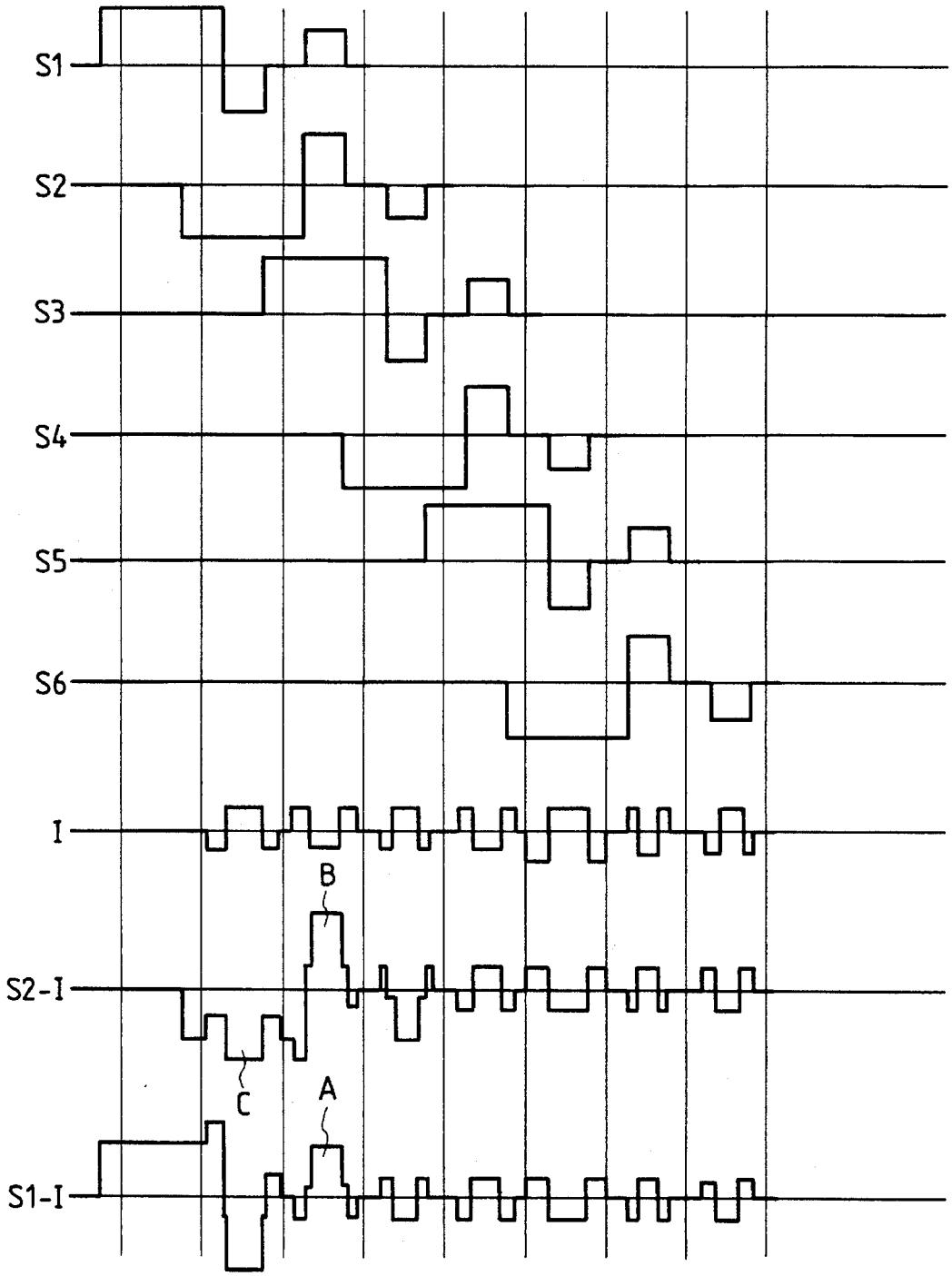
FIG. 27 is a time sequential view which illustrates driving waveforms according to Example 6.

FIG. 27 illustrates a time sequence of the driving waveform.

Referring to FIG. 27, symbols $S_1$ to $S_6$ represent scanning signal waveforms, and I represents an information signal waveform.

A ΔT (pulse width)–V (voltage) curve when the temperature distribution of the liquid crystal panel is restricted to a range from 25°–30° C. is shown in FIG. 3 (characteristics of a 1 μm cell).

The width and the voltage level of each pulse shown in FIGS. 28A and 28B determined as follows.

$dt_1$=240 μs $dt_2$=80 μs $V_1$=11.1 volt $V_2$=6.5 volt $V_3$=5.0 volt

The information signal $dt_3$ is determined by the following equation in the case where the image gradation by X % is performed:

When white is selected;

$$dt_3 = 49.5 \times 10^{\left(\frac{x}{100} \cdot \log \frac{80}{49.5}\right)} \mu s$$

When black is selected;

$$dt_3 = 49.5 \times 10^{\left(\frac{100-x}{100} \cdot \log \frac{80}{49.5}\right)} \mu s$$

$$dt_4 = \frac{1}{2} dt_3$$

It depends upon a result of a process in which a portion of a pixel is written when a pulse having a width of 80 μs and a voltage of 16.5 V when the temperature of the pixel is 25° C. and then the overall portion of the pixel is written after the voltage has been raised to 16.1 V.

Referring to FIG. 27, an electric signal to be applied to the line S2 is represented by S2-1. Among the pulse group, waveform C indicates the deletion of the pixel (collectively written to be white or black), while ensuing waveform B indicates writing on the line $S_2$.

An electrode signal to be supplied to the line $S_1$ is represented by $S_1$-I, and symbol A represents information to be written on the line $S_1$ so as to compensate the temperature of the line $S_2$.

Gradation display by the thus constituted cell and by the arranged driving waveforms, the quality of the gradation display could be improved (the temperature range could be restricted) regardless of the irregular temperature distribution (the temperature was distributed in a range from 25°–30° C.) in the liquid crystal panel.

With the aforesaid method, the time required to drive one frame can be shortened to one-third in comparison to the conventional 4-pulse method. Since one pixel must be subjected to writing three times after the deletion in the 4-pulse method, three times the time required in the present invention was taken.

When the deletion direction by the scanning line is made opposite in the frame, the stability of the domain wall can be improved. It can be considered that the generation of the deviation of ions in the FLC layer is prevented sufficiently.

The arrangement in which gradation information is expressed by the pulse width in place of the voltage will enable the following advantages to be obtained:

(1) An output stage of the driving IC can easily be formed and the electric power consumption can be made to be constant.

(2) Since the pulse width is regulated by the clock signal, the dispersion between the driving ICs can be substantially prevented.

Figures 29A, 29B:
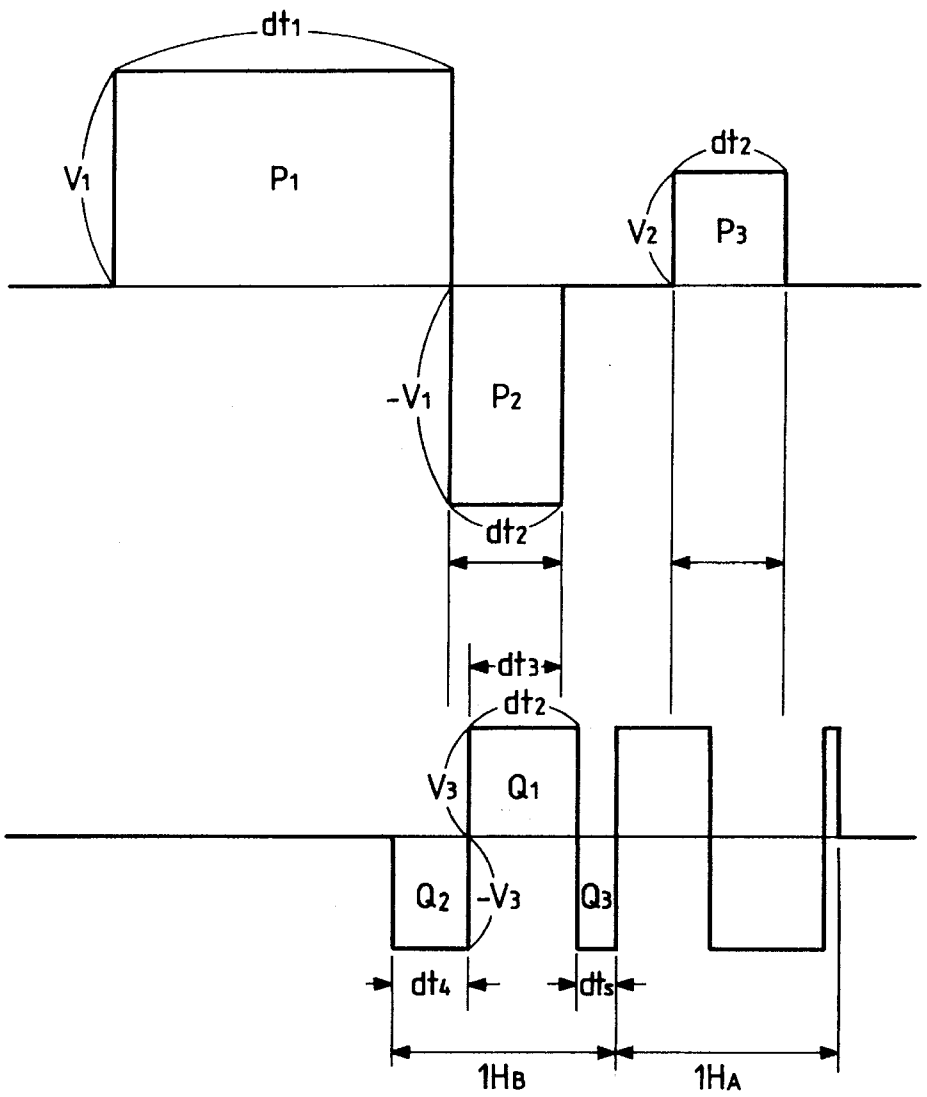
FIGS. 29A and 29B show time sequential views which illustrate driving waveforms according to Example 6.

Also the image gradation can be displayed by moving the phase of the information signal waveform in accordance with gradation information. FIGS. 29A and 29B illustrate the driving waveforms. size 300μm×200 μm.

FIG. 29A is a scanning signal waveform similar to that shown in FIG. 27.

FIG. 29B illustrates an information signal waveform composed of a selection pulse Q1 and sub-pulses $Q_2$ and $Q_3$ for setting off the DC component of the selection pulses $Q_1$.

At this time, $dt_1$=240 μs $dt_2$=80 μs $V_1$=11.1 volt $V_2$=6.5 volt $V_3$=5.0 volt The period $dt_3$ in which the scanning selection pulses P2 and P3 and Q1 are synchronized with each other is determined by the following equation in the case where the image gradation by X % is performed:

When white is selected;

$$dt_3 = 49.5 \times 10^{\left(\frac{x}{100} \cdot \log \frac{80}{49.5}\right)} \mu s$$

When black is selected;

$$dt_3 = 49.5 \times 10^{\left(\frac{100-x}{100} \cdot \log \frac{80}{49.5}\right)} \mu s$$

$$dt_4 = \frac{3}{2} dt_2 - dt_3$$

$$dt_5 = dt_3 - \frac{1}{2} dt_2$$

Figure 30:
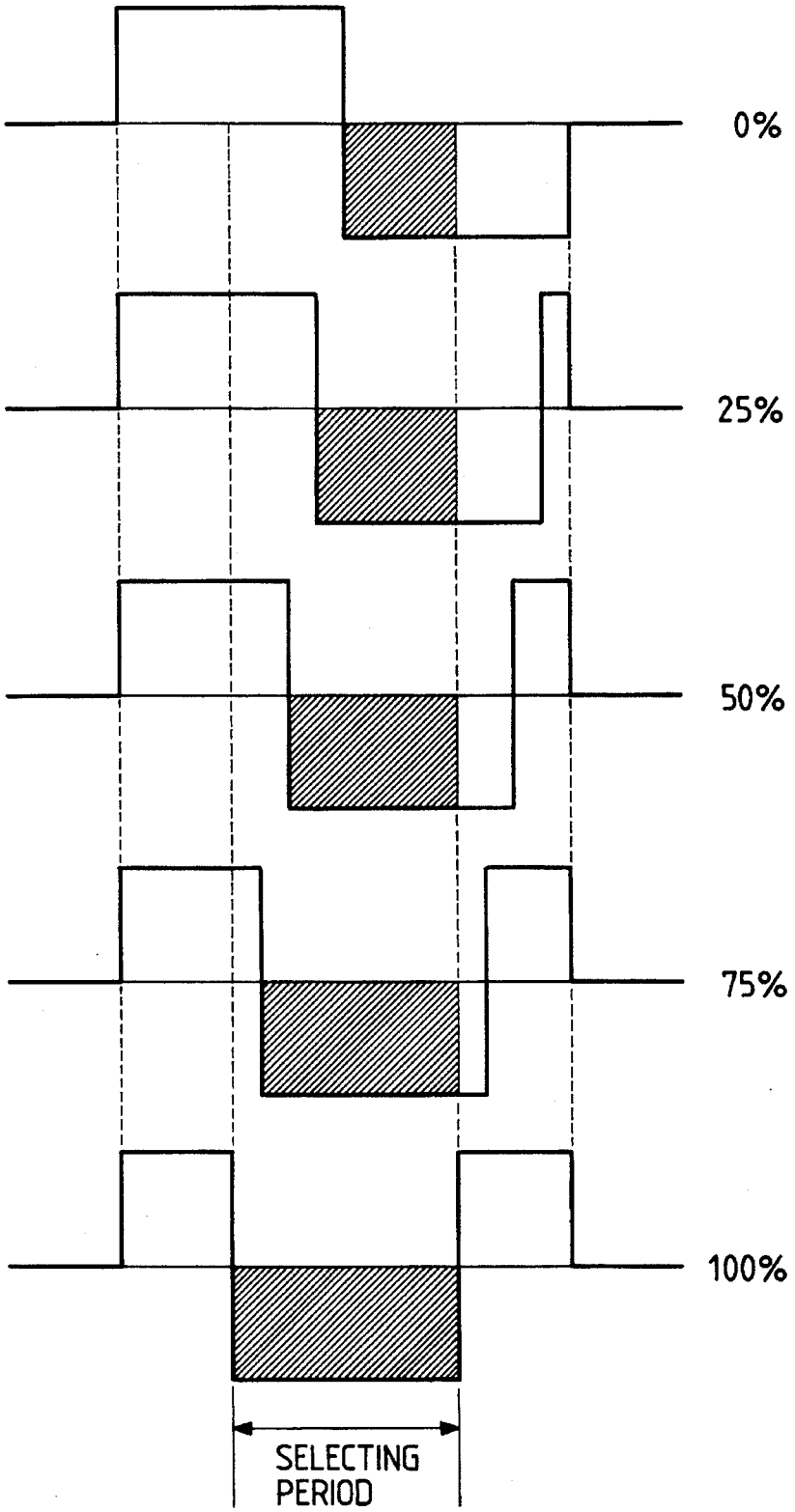
FIG. 30 illustrates other driving waveforms according to Example 6.

A stage where the phase of the information signal is shifted in accordance with the gradation is shown in FIG. 30.

The hatching section shows the portion which synchronizes with the scanning selection period.

The structure in which the gradation is displayed by shifting the phase will enables an advantage to be obtained in that the logic portion of the driving IC can be simplified because the pulse width of Q1 does not depend on information but it is constant.

Even if the liquid crystal material, the thickness of the cell, the orienting conditions, and the ambient temperature and the like are changed, the image gradation can be satisfactorily displayed by adequately setting the parameters of the waveforms shown in FIGS. 27 and 29A and 29B.

(Example 7)

The aforesaid driving method according to the aforesaid embodiments which compensates the temperature change and the cell thickness change is able to compensate the change if the transmissive light quantity of the pixel is changed depending upon the applied voltage although the degree is different depending upon the relationship between the change of the transmittance and the quantity of the change such as the temperature and the thickness of the cell (also the 4-pulse method disclosed in Japanese Patent Application Laid-Open No. 3-73127 is able to compensate the change). For example, material having characteristics as shown in Table 3 in, for example, a smectic C* phase is used.

TABLE 3

| | |
|---|---|
| Phase System | Iso $\xrightarrow{64° C.}$ SmA $\xrightarrow{58° C.}$ SmC* |
| Smectic C-pitch | 0.4 μm |
| Ps | 98 nc/cm$^2$ |

The cell was structured in such a manner that the thickness of the liquid crystal layer in the cell is constant. According to this example, an electrode substrate formed by patterning ITO so as to be a stripe electrode and a polyimide oriented film is formed on it as an oriented film before it is rubbed in parallel in the vertical direction.

In the rubbing process, the orienting characteristics were improved satisfactorily in the case where the mold is rubbed. If a material having a relatively short spiral pitch as shown in Table 3 is used, a multiplicity of sub stable states are realized in addition to the bistable state realized in the SSFLC as the optical characteristics of the cell. When the transmittance in the pixel become 1% in a cell having a thickness of about 2 μm, 10.0 volt is applied while making the pulse width to be 60 μs. When the same becomes 100%, the voltage was 17.1 volt (the temperature was about 30° C.).

When the temperature of the device is changed by about 5° C., the transmittance-voltage curve is translated substantially in parallel.

By using the driving method according to the present invention at this time, the change of the temperature of the transmittance could be restricted to 10% or less.

As a result, image gradation could be displayed satisfactorily by the driving method according to the present invention in both an orientation mode in which no domain wall is formed in the pixel but in which the transmissive light quantity is changed or an orientation mode in which the domain wall is formed.

As described above, according to the present invention, there is provided a .liquid crystal display apparatus comprising: a liquid crystal cell in which ferroelectric liquid crystal is disposed between two electrode substrates disposed to fact each other and an intersection portion between a scanning electrode group and an information electrode group respectively formed on said electrode substrates is made to be a pixel; scanning signal applying means; and information signal applying means, wherein said pixel has a threshold distribution with respect to a gradation information signal at the time of a scanning selection operation, said scanning signal applying means simultaneously applies scanning signals to a plurality of scanning electrodes in synchronization with an operation in which said information signal applying means applies said gradation information signal to an information electrode, and said scanning signals applied simultaneously have different waveforms. As a result, the change of the threshold taken place due to the irregular temperature distribution in the display portion and that of the thickness can be compensated. Consequently, the image gradation can be quickly reproduced.

What is claimed is:

1. A liquid crystal display apparatus comprising:

optical modulation means having a substrate on which plural scanning electrodes are provided, a substrate on which plural information electrodes are provided perpendicular to said scanning electrodes to define picture elements at intersections therebetween, and a liquid crystal layer provided between said substrates; and driving means including a scanning means for applying a scanning selection signal to the scanning electrodes, and information signal applying means for applying an information signal to the information electrodes, wherein a first part of a pixel is defined by a picture element, at the intersection of a first one of the scanning electrodes and a first one of the information electrodes, and a second part of the pixel is defined by a picture element at the intersection of a second scanning electrode, adjacent to the first scanning electrode, and the first information electrode, and wherein gradation information per unit pixel is reproduced in a region defined by the first and second parts in which a sum of areas of the first and second parts substantially equals an area of a pixel, and wherein an erasing pulse, a first writing pulse and a compensation pulse are applied sequentially in distinct timings to the second scanning electrode and a second writing pulse is applied to the first scanning electrode, and, when the first writing pulse and the compensation pulse are applied to the second scanning electrode, a display state of the picture element at the intersection between the first scanning electrode and the first information electrode is substantially unchanged after the application of the first writing pulse and after the application of the compensation pulse to the second scanning electrode.

2. A liquid crystal display apparatus according to claim 1, wherein a position of said region within the pixel can be moved according to a temperature.

3. A liquid crystal display apparatus according to claim 1, wherein said region covers the first and second scanning electrodes.

4. A liquid crystal display apparatus according to claim 1, wherein writing into said region is performed by the scanning selection signal and the information signal for the picture element on the first scanning electrode, and by scanning selection signal and the information signal for the picture element on the second scanning electrode.

5. A liquid crystal display apparatus according to claim 1, wherein said liquid crystal is a ferroelectric liquid crystal.

6. A liquid crystal display apparatus according to claim 1, wherein the gradation writing is based on a ratio between a dark area and a light area within said region.

7. A liquid crystal display apparatus according to any of claims 1–6, wherein said pixel has a predetermined threshold inclination.

8. A liquid crystal display apparatus according to any of claims 1–6, wherein a thickness of the liquid crystal layer within the pixel varies.

9. A liquid crystal display apparatus according to claim 1, wherein writing of the gradation information into said region is performed by an information signal subjected to pulse width modulation.

10. A liquid crystal display apparatus according to claim 1, wherein writing of the gradation information into said region is performed by an information signal subjected to a voltage modulation.

* * * * *

UNITED STATES PATENT AND TRADEMARK OFFICE

CERTIFICATE OF CORRECTION

PATENT NO. : 5,519,411

DATED : May 21, 1996

INVENTORS : Okada Shinjiro et al.

It is certified that error appears in the above-identified patent and that said Letters Patent is hereby corrected as shown below:

COLUMN 1

Line 21, "whcih" should read --which--, and
Line 29, "to be utilized", second occurrence, should be deleted.

COLUMN 3

Line 61, "liqud" should read --liquid--, and
Line 65, "fact" should read --face--.

COLUMN 5

Line 54, "temperature" should read --temperatures--, and
Line 62, "dispaly" should read --display--.

COLUMN 7

Line 21, "dispalyed" shoud read --displayed--, and
Line 29, "a" should be deleted.

COLUMN 8

Line 41, "cahracteristics" should read --characteristics--.

COLUMN 9

Line 16, "[1]+[2]+[3]" should read --[1]→[2]→[3]--.

UNITED STATES PATENT AND TRADEMARK OFFICE

CERTIFICATE OF CORRECTION

PATENT NO. : 5,519,411

DATED : May 21, 1996

INVENTORS : Shinjiro Okada et al.

It is certified that error appears in the above-identified patent and that said Letters Patent is hereby corrected as shown below:

COLUMN 10

Line 17, "have" should read --to have--, and
Line 46, "threhsold" should read --threshold--.

COLUMN 11

Line 43, "feild" should read --field--, and
Line 49, "coincide" should read --coincident--.

COLUMN 13

Line 2, "[1]+[2]+[3]" should read --[1]→[2]→[3]--.

COLUMN 14

Line 2, "coincide" should read --coincident--,
Line 6, "iamge" should read --image--, and
Line 65, "rectangular" should read --rectangle--.

COLUMN 15

Line 63, "regradless" should read --regardless---.

COLUMN 17

Line 6, "a" should be deleted, and
Line 37, "processes" should read --process--.

UNITED STATES PATENT AND TRADEMARK OFFICE

CERTIFICATE OF CORRECTION

PATENT NO. : 5,519,411

DATED : May 21, 1996

INVENTORS : Shinjiro Okada et al.

It is certified that error appears in the above-identified patent and that said Letters Patent is hereby corrected as shown below:

COLUMN 21

Line 40, "is" should read --are--.

COLUMN 22

Line 18, "rectangular" should read --rectangle--,
Line 20, "illustrates" should read --illustrate--, and
Line 36, "other" should read --other.--.

COLUMN 23

Line 51, "a" should be deleted.

COLUMN 24

Line 16, "rectangular" should read --rectangle--.

COLUMN 26

Line 2, "will" should be deleted,
Line 43, "become" should read --becomes--,
Line 61, ".liquid" should read --liquid--, and
Line 64, "fact" should read --face--.

COLUMN 27

Line 28, "a first" should be deleted, and
Line 32, "first" should read --one--.

UNITED STATES PATENT AND TRADEMARK OFFICE

CERTIFICATE OF CORRECTION

PATENT NO. : 5,519,411

DATED : May 21, 1996

INVENTORS : Shinjiro Okada et al.

It is certified that error appears in the above-identified patent and that said Letters Patent is hereby corrected as shown below:

COLUMN 28

Line 4, "first" should read --one--, and
Line 17, "by" should read --by the--.

Signed and Sealed this

Fifteenth Day of October, 1996

Bruce Lehman

*Attest:*

BRUCE LEHMAN

*Attesting Officer*

*Commissioner of Patents and Trademarks*